US007996215B1

(12) United States Patent
Wang et al.

(10) Patent No.: US 7,996,215 B1
(45) Date of Patent: Aug. 9, 2011

(54) METHOD AND APPARATUS FOR VOICE ACTIVITY DETECTION, AND ENCODER

(75) Inventors: Zhe Wang, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/086,099

(22) Filed: Apr. 13, 2011

Related U.S. Application Data

(63) Continuation of application No. PCT/CN2010/077726, filed on Oct. 14, 2010.

(30) Foreign Application Priority Data

Oct. 15, 2009 (CN) ..... 2009 1 0207311

(51) Int. Cl.
*G10L 11/06* (2006.01)
*G10L 21/00* (2006.01)

(52) U.S. Cl. ..... 704/208; 704/210; 704/233; 704/236; 455/79; 455/412.1; 455/414.4; 455/432.2; 370/352; 379/88.01; 379/202.01; 379/390.01

(58) Field of Classification Search ..... 704/208
See application file for complete search history.

(56) References Cited

U.S. PATENT DOCUMENTS

| | | | |
|---|---|---|---|
| 5,276,765 | A | 1/1994 | Freeman et al. |
| 5,410,632 | A | 4/1995 | Hong et al. |
| 5,459,814 | A | 10/1995 | Gupta et al. |
| 5,649,055 | A | 7/1997 | Gupta et al. |
| 6,154,721 | A | 11/2000 | Sonnic |
| 6,188,884 | B1 | 2/2001 | Lorieau et al. |
| 6,381,570 | B2 | 4/2002 | Li et al. |
| 6,424,938 | B1 | 7/2002 | Johansson et al. |
| 6,453,291 | B1 | 9/2002 | Ashley |
| 7,133,327 | B2 | 11/2006 | Zhu et al. |
| 2002/0010580 | A1 | 1/2002 | Li et al. |
| 2002/0188445 | A1 | 12/2002 | Li |
| 2010/0088094 | A1 | 4/2010 | Wang |

FOREIGN PATENT DOCUMENTS

CN 1204766 A 1/1999

(Continued)

OTHER PUBLICATIONS

Foreign communication from a counterpart application, PCT application PCT/CN2010/077726, International Search Report and Written Opinion dated Jan. 20, 2011.

(Continued)

*Primary Examiner* — Justin Rider
(74) *Attorney, Agent, or Firm* — Conley Rose, P.C.; Grant Rodolph

(57) ABSTRACT

A method and an apparatus for Voice Activity Detection (VAD) and an encoder are provided. The method for VAD includes: acquiring a fluctuant feature value of a background noise when an input signal is the background noise, in which the fluctuant feature value is used to represent fluctuation of the background noise; performing adaptive adjustment on a VAD decision criterion related parameter according to the fluctuant feature value; and performing VAD decision on the input signal by using the decision criterion related parameter on which the adaptive adjustment is performed. The method, the apparatus, and the encoder can be adaptive to fluctuation of the background noise to perform VAD decision, so as to enhance the VAD decision performance, save limited channel bandwidth resources, and use the channel bandwidth efficiently.

20 Claims, 14 Drawing Sheets

FOREIGN PATENT DOCUMENTS

| | | | |
|---|---|---|---|
| CN | 1419687 | A | 5/2003 |
| CN | 1773605 | A | 5/2006 |
| CN | 101320559 | A | 12/2008 |
| EP | 2159788 | A1 | 3/2010 |
| WO | 9313516 | A1 | 7/1993 |
| WO | 2008148323 | A1 | 11/2008 |

OTHER PUBLICATIONS

Foreign communication from a counterpart application, PCT application PCT/CN2010/077726, Partial English Translation Written Opinion dated Jan. 20, 2011.

"Telecommunications: Analog to Digital Conversation of Radio Voice by 4,800 Bit/Second Code Excited Linear Prediction (CELP)," Federal Standard, FED-STD 1016, Feb. 14, 1991.

"3rd Generation Partnership Project; Technical Specification Group Services and System Aspects; Speech codec speed processing functions; Adaptive Multi-Rate-Wideband (AMR-WB) speech codec; Transcoding functions (Release 6)," 3GPP TS 26.190 V6.0.0 (Dec. 2004).

"Series G: Transmission Systems and Media, Digital Systems and Networks, Digital terminal equipments—Coding of analogue signals by methods other than PCM, G.729-based embedded variable bit-rate coder: An 8-32 kbit/s scalable wideband coder bitstream interoperable with G.729," ITU-T Recommendation G.729.1, (May 2006).

"Series G: Transmission Systems and Media, Digital transmission systems—Terminal equipments—Coding of analogue signals by methods other than PCM, Coding of speech at 8 kbit/s using conjugate structure algebraic-code-excited excited linear-prediction (CS-ACELP), Annex B: A silence compression scheme for G.729 optimized for terminals conforming to Recommendation V.70," ITU-T Recommendation G.729 Annex B, (Nov. 1996).

METHOD AND APPARATUS FOR VOICE ACTIVITY DETECTION, AND ENCODER

CROSS-REFERENCE TO RELATED APPLICATIONS

This application is a continuation of International Application No. PCT/CN2010/077726, filed Oct. 14, 2010, which claims priority from Chinese Patent Application No. 200910207311.4, filed Oct. 15, 2009, both of which are hereby incorporated by reference in their entirety.

FIELD OF THE INVENTION

The present invention relates to communication technologies, and in particular, to a method and an apparatus for Voice Activity Detection (VAD), and an encoder.

BACKGROUND OF THE INVENTION

In a communication system, especially in a wireless communication system or a mobile communication system, channel bandwidth is a rare resource. According to statistics, in a bi-directional call, the talk time for both parties of the call only accounts for about half of the total talk time, and the call in the other half of the total talk time is in a silence state. Because the communication system only transmits signals when people talk and stops transmitting signals in the silence state, but cannot assign bandwidth occupied in the silence state to other communication services, which severely wastes the limited channel bandwidth resources.

To make full use of the channel resources, in the prior art, the time when the two parties of the call start to talk and when they stop talking are detected by using a VAD technology, that is, the time when the voice is activated is acquired, so as to assign the channel bandwidth to other communication services when the voice is not activated. With the development of the communication network, the VAD technology may also detect input signals, such as ring back tones. In a VAD system based on the VAD technology, it is usually judged that input signals are foreground signals or background noises according to a preset decision criterion that includes decision parameters and decision logics. Foreground signals include voice signals, music signals, and Dual Tone Multi Frequency (DTMF) signals, and the background noises do not include the signals. Such judgment process is also called VAD decision.

At the early stage of the development of the VAD technology, a static decision criterion is adopted, that is, no matter what the characteristics of an input signal are, the decision parameters and decision logics of the VAD remain unchanged. For example, in the G.729 standard-based VAD technology, regardless of the type of the input signal, the Signal to Noise Ratio (SNR) is, and the characteristics of the background noise, the same group of decision parameters are used to perform the VAD decision with the same group of decision logics and decision thresholds. Because the G.729 standard-based VAD technology is designed and presented based on a high SNR condition, the performance of the VAD technology is worse in a low SNR condition. With the development of the VAD technology, a dynamic decision criterion is proposed, in which the VAD technology can select different decision parameters and/or different decision thresholds according to different characteristics of the input signal and judge that the input signal is a foreground signal or background noise. Because the dynamic decision criterion is adopted to determine decision parameters or decision logics according to specific features of the input signal, the decision process is optimized and the decision efficiency and decision accuracy are enhanced, thereby improving the performance of the VAD decision. Further, if the dynamic decision criterion is adopted, different VAD outputs can be set for the input signal with different characteristics according to specific application demands. For example, when an operator hopes to transmit background information about some speakers in the VAD system to some extent, a VAD decision tendency can be set in the case that the background noise contains greater amount of information, so as to make it easier to judge that the background noise containing greater amount of information is also a voice frame. Currently, dynamic decision has been achieved in an adaptive multi-rate voice encoder (AMR for short). The AMR can dynamically adjust the decision threshold, hangover length, and hangover trigger condition of the VAD according to the level of the background noise in the input signal.

However, when the existing AMR performs the VAD decision, the AMR can only be adaptive to the level of the background noise but cannot be adaptive to fluctuation of the background noise. Thus, the performance of the VAD decision for the input signal owning different types of background noises may be quite different. For example, under the level of the same background noise, the AMR has much higher VAD decision performance in the case that the background noise is car noise, but the VAD decision performance is reduced significantly in the case that the background noise is babble noise, causing a tremendous waste of the channel bandwidth resources.

SUMMARY OF THE INVENTION

The embodiments of the present invention provide a method and an apparatus for VAD, and an encoder, being adaptive to fluctuation of a background noise to perform VAD decision, thereby improving VAD decision performance, reducing limited channel bandwidth resources, and using channel bandwidth efficiently.

An embodiment of the present invention provides a method for VAD. The method includes: acquiring a fluctuant feature value of a background noise when an input signal is the background noise, in which the fluctuant feature value is used to represent fluctuation of the background noise; performing an adaptive adjustment on a VAD decision criterion related parameter according to the fluctuant feature value; and performing the VAD decision on the input signal by using the VAD decision criterion related parameter on which the adaptive adjustment is performed.

An embodiment of the present invention provides an apparatus for VAD. The apparatus includes: an acquiring module configured to acquire a fluctuant feature value of a background noise when an input signal comprises the background noise, in which the fluctuant feature value is used to represent fluctuation of the background noise; an adjusting module configured to perform adaptive adjustment on a VAD decision criterion related parameter according to the fluctuant feature value; and a deciding module configured to perform a VAD decision on the input signal by using the VAD decision criterion related parameter on which the adaptive adjustment is performed.

An embodiment of the present invention provides an encoder, including the apparatus for VAD according to the embodiment of the present invention.

Based on the method for VAD, the apparatus for VAD, and the encoder according to the embodiments of the present invention, when an input signal is a background noise, a fluctuant feature value used to represent fluctuation of the background noise can be acquired, adaptive adjustment is performed on a VAD decision criterion related parameter according to the fluctuant feature value, and VAD decision is performed on the input signal by using the decision criterion related parameter on which the adaptive adjustment is performed. Compared with the prior art, the technical solution of the present invention can achieve higher VAD decision performance in the case of different types of background noises, because the VAD decision criterion related parameter in the embodiment of the present invention can be adaptive to the fluctuation of the background noise. This improves the VAD decision efficiency and decision accuracy, thereby increasing utilization of the limited channel bandwidth resources.

The technical solution of the present invention is described in further detail with reference to the accompanying drawings and embodiments.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

The technical solution of the present invention is clearly and completely described in the following with reference to the accompanying drawings. It is obvious that the embodiments to be described are only a part rather than all of the embodiments of the present invention. All other embodiments acquired by persons skilled in the art based on the embodiments of the present invention without creative efforts shall fall within the protection scope of the present invention.

Figure 1:
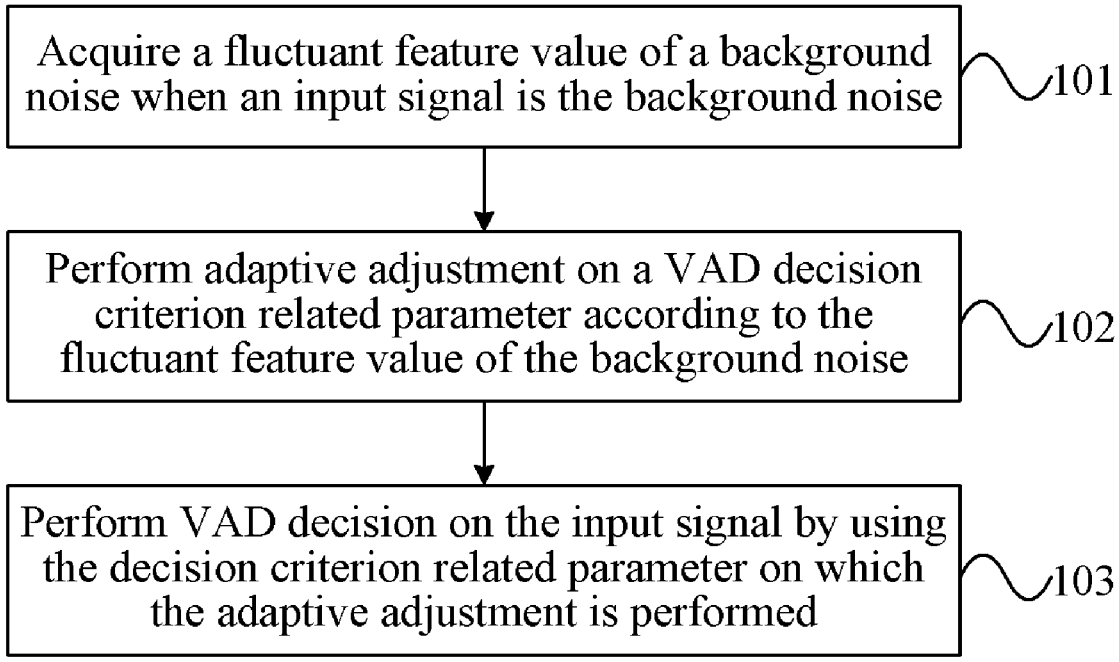
FIG. 1 is a flow chart of an embodiment of a method for VAD according to the present invention.

FIG. 1 is a flow chart of an embodiment of a method for VAD according to the present invention. As shown in FIG. 1, the method for VAD according to this embodiment includes the following steps:

Step 101: Acquire a fluctuant feature value of a background noise when an input signal is the background noise, in which the fluctuant feature value is used to represent fluctuation of the background noise.

Step 102: Perform adaptive adjustment on a VAD decision criterion related parameter according to the fluctuant feature value of the background noise.

Step 103: Perform VAD decision on the input signal by using the decision criterion related parameter on which the adaptive adjustment is performed.

With the method for VAD according to the embodiment of the present invention, when an input signal is a background noise, a fluctuant feature value used to represent fluctuation of the background noise can be acquired, adaptive adjustment is performed on a VAD decision criterion related parameter according to the fluctuant feature value, so as to make the VAD decision criterion related parameter adaptive to the fluctuation of the background noise. In this way, when VAD decision is performed on the input signal by using the decision criterion related parameter on which the adaptive adjustment is performed, higher VAD decision performance can be achieved in the case of different types of background noises, which improves the VAD decision efficiency and decision accuracy, thereby increasing utilization of limited channel bandwidth resources.

According to a specific embodiment of the present invention, the VAD decision criterion related parameter may include any one or more of a primary decision threshold, a hangover trigger condition, a hangover length, and an update rate of an update rate of a long term parameter related to background noise.

When the VAD decision criterion related parameter includes the primary decision threshold, according to an embodiment of the present invention, step 102 can be specifically implemented in the following ways:

A mapping between a fluctuant feature value and a decision threshold noise fluctuation bias thr_bias_noise is queried, and a decision threshold noise fluctuation bias thr_bias_noise corresponding to the fluctuant feature value of the background noise is acquired, in which the decision threshold noise fluctuation bias thr_bias_noise is used to represent a threshold bias value under a background noise with different fluctuation, and the mapping may be set previously or currently, or may be acquired from other network entities.

A VAD primary decision threshold vad_thr is acquired by using the formula $$vad_thr=f_1(snr)+f_2(snr)\cdot thr_bias_noise,$$

in which $f_1(snr)$ is a reference threshold corresponding to an SNR snr of a current background noise frame, and $f_2(snr)$ is a weighting coefficient of a decision threshold noise fluctuation bias thr_bias_noise corresponding to the SNR snr of the current background noise frame.

Specifically, a function form of $f_1(snr)$ and $f_2(snr)$ to snr may be set according to empirical values.

The primary decision threshold in the VAD decision criterion related parameter is updated to the acquired primary decision threshold vad_thr, so as to implement adaptive adjustment on the VAD primary decision threshold vad_thr according to the fluctuant feature value of the background noise.

When the VAD decision criterion related parameter includes the hangover trigger condition, according to an embodiment of the present invention, step 102 can be specifically implemented in the following ways:

A successive-voice-frame length burst_cnt_noise_tbl [fluctuant feature value] corresponding to the fluctuant feature value of the background noise is queried from a successive-voice-frame length noise fluctuation mapping table burst_cnt_noise_tbl[ ], and a determined voice threshold burst_thr_noise_tbl[fluctuant feature value] corresponding to the fluctuant feature value of the background noise is queried from a threshold bias table of determined voice according to noise fluctuation burst_thr_noise_tbl[ ], in which the successive-voice-frame length noise fluctuation mapping table burst_cnt_noise_tbl[ ] and the threshold bias table of determined voice according to noise fluctuation burst_thr_noise_tbl[ ] may also be set previously or currently, or acquired from other network entities.

A successive-voice-frame quantity threshold M is acquired by using the formula $$M=f_3(snr)+f_4(snr)\cdot burst_cnt_noise_tbl[\text{fluctuant feature value}], \text{ and}$$

a determined voice frame threshold burst_thr is acquired by using the formula $burst_thr=f_5(snr)+f_6(snr)\cdot burst_thr_noise_tbl[\text{fluctuant feature value}]$, in which $f_3(snr)$ is a reference quantity threshold corresponding to an SNR snr of a current background noise frame, $f_4(snr)$ is a weighting coefficient of the successive-voice-frame length burst_cnt_noise_tbl[fluctuant feature value] corresponding to the SNR snr of the current background noise frame, $f_5(snr)$ is a reference voice frame threshold corresponding to the SNR snr of the current background noise frame, and $f_6(snr)$ is a weighting coefficient of the determined voice threshold burst_thr_noise_tbl[fluctuant feature value] corresponding to the SNR snr of the current background noise frame.

Specifically, function forms of $f_3(snr)$, $f_4(snr)$, $f_5(snr)$, and $f_6(snr)$ to snr may be set according to empirical values. As a specific embodiment, the specific function forms of $f_3(snr)$, $f_4(snr)$, $f_5(snr)$, and $f_6(snr)$ to snr may enable the successive-voice-frame quantity threshold M and the determined voice frame threshold burst_thr to increase with decrease of the acquired fluctuant feature value. The hangover trigger condition in the VAD decision criterion related parameter is updated according to the acquired successive-voice-frame quantity threshold M and determined voice frame threshold burst_thr, so as to implement adaptive adjustment on the hangover trigger condition of the VAD according to the fluctuant feature value of the background noise.

When the VAD decision criterion related parameter includes the hangover length, according to an embodiment of the present invention, step 102 can be specifically implemented in the following ways:

A hangover length hangover_nosie_tbl[fluctuant feature value] corresponding to the fluctuant feature value of the background noise is queried from a hangover length noise fluctuation mapping table hangover_noise_tbl[ ], in which the hangover length noise fluctuation mapping table hangover_noise_tbl[ ] may be set previously or currently, or acquired from other network entities.

A hangover counter reset maximum value hangover_max is queried by using the formula $$hangover_max=f_7(snr)+f_8(snr)\cdot hangover_noise_tbl[\text{fluctuant feature value}],$$

in which $f_7(snr)$ is a reference reset value corresponding to an SNR snr of a current background noise frame, and $f_8(snr)$ is a weighting coefficient of a hangover length hangover_nosie_tbl[fluctuant feature value] corresponding to the SNR snr of the current background noise frame.

Specifically, a function form of $f_7(snr)$ and $f_8(snr)$ to snr may be set according to empirical values. As a specific embodiment, the specific function form of $f_7(snr)$ and $f_8(snr)$ to snr may enable the hangover counter reset maximum value hangover_max to increase with increase of the acquired fluctuant feature value.

The hangover length in the VAD decision criterion related parameter is updated to the acquired hangover counter reset maximum value hangover_max, so as to implement adaptive adjustment on the hangover length of the VAD according to the fluctuant feature value of the background noise.

Figure 2:
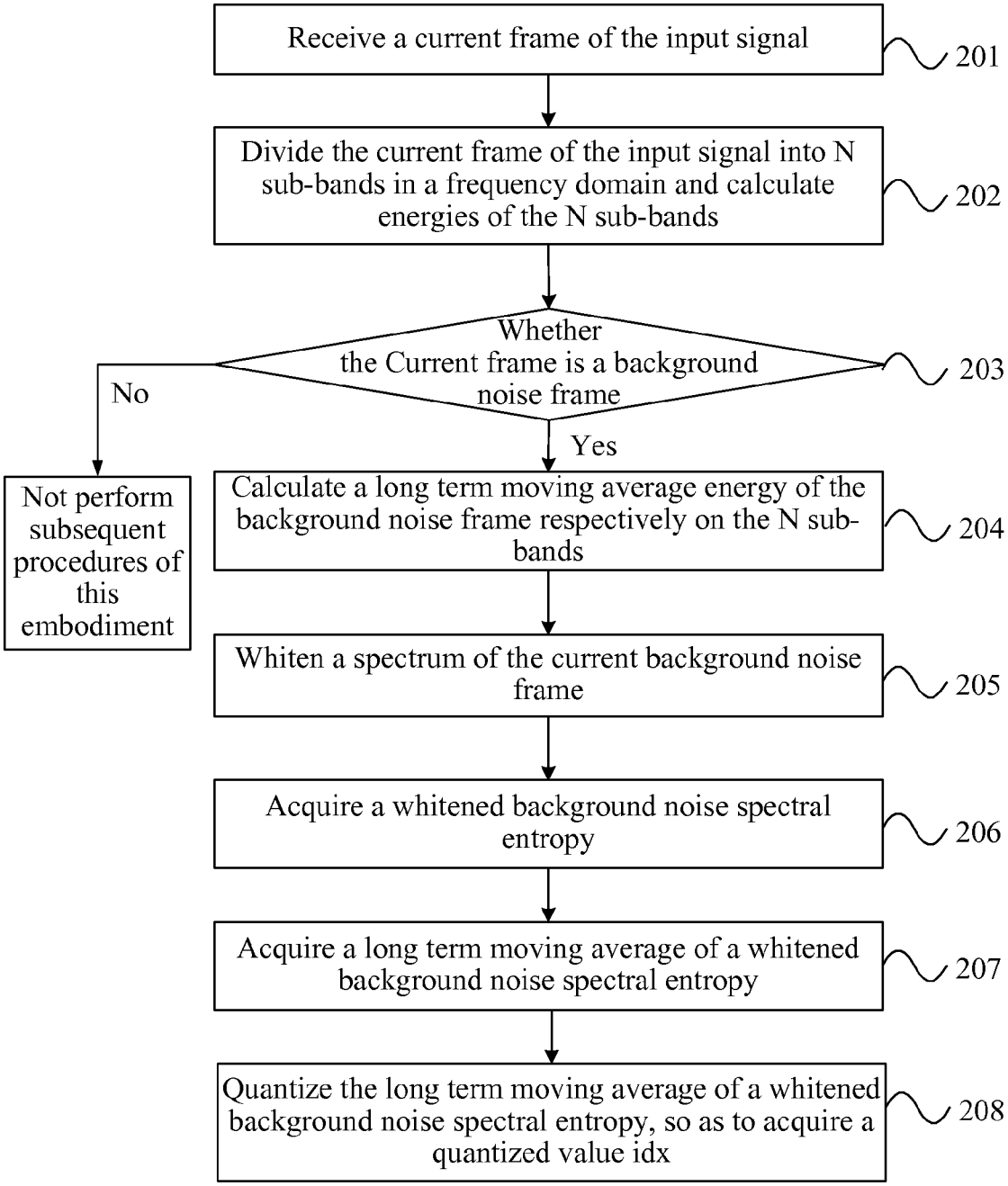
FIG. 2 is a flow chart of an embodiment of acquiring a fluctuant feature value of a background noise according to the present invention.

According to a specific embodiment of the method for VAD of the present invention, a long term moving average hb_noise_mov of a whitened background noise spectral entropy may be adopted to represent the fluctuation of the background noise. FIG. 2 is a flow chart of an embodiment of acquiring a fluctuant feature value of a background noise according to the present invention. In this embodiment, the fluctuant feature value is specifically a quantized value idx of the long term moving average hb_noise_mov of a whitened background noise spectral entropy. As shown in FIG. 2, the process according to this embodiment includes the following steps:

Step 201: Receive a current frame of the input signal.

Step 202: Divide the current frame of the input signal into N sub-bands in a frequency domain, in which N is an integer greater than 1, for example, N may be 32, and calculate energies enrg(i) (in which $i=0, 1, \ldots, N-1$) of the N sub-bands respectively.

Specifically, the N sub-bands may be of equal width or of unequal width, or any number of sub-bands in the N sub-bands may be of equal width.

Step 203: Decide whether the current frame is a background noise frame according to the VAD decision criterion. If the current frame is a background noise frame, perform step 204; if the current frame is not a background noise frame, do not perform subsequent procedures of this embodiment.

Step 204: Calculate a long term moving average energy enrg_n(i) of the background noise frame respectively on the N sub-bands by using the formula $enrg_n(i)=\alpha\cdot enrg_n+(1-\alpha)\cdot enrg(i)$, in which $\alpha$ is a forgetting coefficient for controlling an update rate of the long term moving average energy enrg_n(i) of the background noise frame respectively on the N sub-bands, and enrg_n is an energy of the background noise frame.

Step 205: whiten a spectrum of the current background noise frame by using the formula $$\text{enrg_}w(i)=\text{enrg}(i)/\text{enrg_}n(i),$$

and an energy enrg_w(i) of the whitened background noise on an $i^{th}$ sub-band is acquired.

Step 206: Acquire a whitened background noise spectral entropy hb by using the formula $$hb=-\sum_{i=0}^{N-1} p_i\cdot\log p_i,\text{ in which } p_i=\text{enrg_w}(i)\Big/\sum_{i=0}^{N-1}\text{enrg_w}(i).$$

Step 207: Acquire a long term moving average hb_noise_mov of a whitened background noise spectral entropy by using the formula $$hb_\text{noise_mov}=\beta\cdot hb_\text{noise_mov}+(1\beta)\cdot hb,$$

in which β is a forgetting factor for controlling the update rate of the long term moving average hb_noise_mov of a whitened background noise spectral entropy.

In this embodiment, the long term moving average hb_noise_mov of a whitened background noise spectral entropy represents the fluctuation of the background noise. The larger the hb_noise_mov is, the smaller the fluctuation of the background noise is; on the contrary, the smaller the hb_noise_mov is, the larger the fluctuation of the background noise is.

Step 208: Quantize the long term moving average hb_noise_mov of a whitened background noise spectral entropy by using the formula $$idx=|(hb_\text{noise_mov}-A)/B|,\text{ so as to acquire a quantized value } idx,$$

in which A and B are preset values, for example, A may be an empirical value 3.11, and B may be an empirical value 0.05.

Corresponding to the embodiment shown in FIG. 2, when the fluctuant feature value is specifically the quantized value idx of the long term moving average hb_noise_mov of a whitened background noise spectral entropy, as an embodiment of the present invention, the update rate of background noise related long term parameter may include the update rate of a long term moving average energy enrg_n(i) of the background noise. Correspondingly, step 102 can be specifically implemented in the following ways:

A background noise update rate table alpha_tbl[ ] is queried, and a forgetting coefficient α of the update rate of the long term moving average energy enrg_n(i) corresponding to the quantized value idx of the background noise is acquired. Specifically, the background noise update rate table alpha_tbl[ ] may be set previously or currently, or may be acquired from other network entities. As a specific embodiment, the setting of the background noise update rate table alpha_tbl[ ] may enable the forgetting coefficient α of the update rate the long term moving average energy enrg_n(i) to decrease with decrease of the quantized value idx of the background noise.

The acquired forgetting coefficient α is used as a forgetting coefficient for controlling the update rate of the long term moving average energy enrg_n(i) of the background noise frame respectively on the N sub-bands, so as to implement adaptive adjustment on the update rate of the long term moving average energy enrg_n(i) of the background noise frame respectively on the N sub-bands according to the fluctuant feature value of the background noise.

Moreover, corresponding to the embodiment shown in FIG. 2, when the fluctuant feature value is specifically the quantized value idx of the long term moving average hb_noise_mov of a whitened background noise spectral entropy, as an embodiment of the present invention, the update rate of the background noise related long term parameter may also include the update rate of the long term moving average hb_noise_mov of a whitened background noise spectral entropy. Correspondingly, step 102 can be specifically implemented in the following ways:

A background noise fluctuation update rate table beta_tbl[ ] is queried, and a forgetting factor β of the update rate of the long term moving average hb_noise_mov corresponding to the quantized value idx of the background noise is acquired. Specifically, the background noise fluctuation update rate table beta_tbl[ ] may be set previously or currently, or may be acquired from other network entities. As a specific embodiment, the specific setting of the background noise fluctuation update rate table beta_tbl[ ] may enable the forgetting factor β of the update rate of the long term moving average hb_noise_mov to increase with decrease of the quantized value idx of the background noise.

The acquired forgetting factor β is used as a forgetting factor for controlling the update rate of the long term moving average hb_noise_mov of a whitened background noise spectral entropy, so as to implement adaptive adjustment on the update rate of the long term moving average hb_noise_mov of a whitened background noise spectral entropy according to the fluctuant feature value of the background noise.

With respect to the background noise with different fluctuant feature values, the long term moving average energy enrg_n(i) of the background noise frame respectively on the N sub-bands and the long term moving average hb_noise_ ov of a whitened background noise spectral entropy are updated with different rates, which can improve the detection rate for the background noise effectively.

Figure 3:
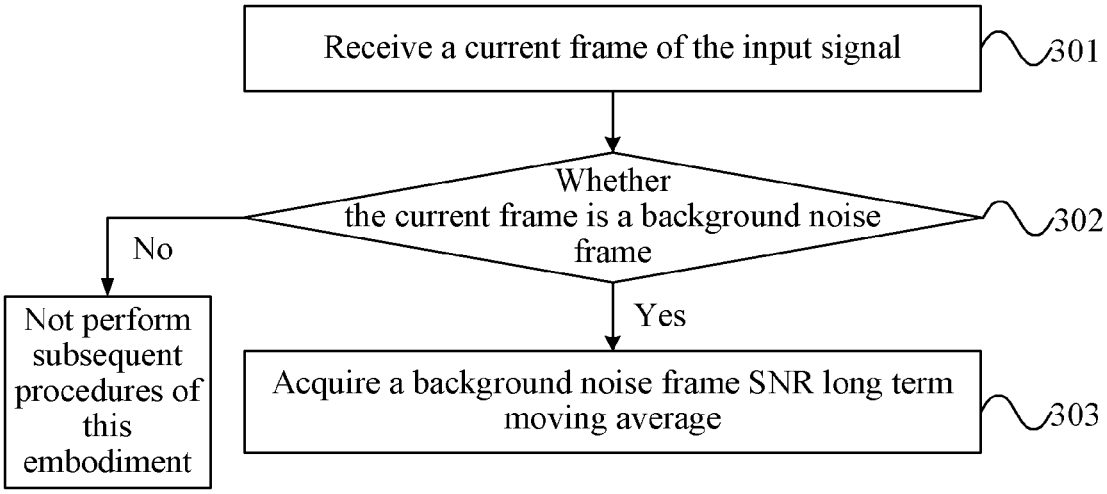
FIG. 3 is a flow chart of another embodiment of acquiring the fluctuant feature value of the background noise according to the present invention.

According to another specific embodiment of the method for VAD of the present invention, a background noise frame SNR long term moving average $\text{snr}_n_\text{mov}$ may be used as a fluctuant feature value of the background noise, so as to represent the fluctuation of the background noise. FIG. 3 is a flow chart of another embodiment of acquiring the fluctuant feature value of the background noise according to the present invention. In this embodiment, the fluctuant feature value of the background noise is specifically the background noise frame SNR long term moving average $\text{snr}_n_\text{mov}$. As shown in FIG. 3, the process according to this embodiment includes the following steps:

Step 301: Receive a current frame of the input signal.

Step 302: Decide whether the current frame is a background noise frame according to the VAD decision criterion. If the current frame is a background noise frame, perform step 303; if the current frame is not a background noise frame, do not perform subsequent procedures of this embodiment.

Step 303: Acquire a background noise frame SNR long term moving average $\text{snr}_n_\text{mov}$ by using the formula $$\text{snr}_n_\text{mov}=k\cdot\text{snr}_n_\text{mov}+(1-k)\cdot\text{snr}.$$

snr is an SNR of the current background noise frame, and k is a forgetting factor for controlling an update rate of the background noise frame SNR long term moving average $\text{snr}_n_\text{mov}$.

Corresponding to the embodiment shown in FIG. 3, when the fluctuant feature value of the background noise is specifically the background noise frame SNR long term moving average $\text{snr}_n_\text{mov}$, as an embodiment of the present invention, the update rate of the background noise related long term parameter may include the update rate of the long term moving average $snr_n$_mov. Correspondingly, step 102 can be specifically implemented in the following ways: setting different values for the forgetting factor k for controlling the update rate of the background noise frame SNR long term moving average $snr_n$_mov when the SNR snr of the current background noise frame is greater than a mean $snr_n$ of SNRs of last n background noise frames, and when the SNR snr of the current background noise frame is smaller than the mean $snr_n$ of the SNR SNRs of the last n background noise frames. For example, when $snr_n$_mov<snr, k is set to be x, and when $snr_n$_mov≧snr, k is set to be y.

The background noise frame SNR long term moving average $snr_n$_mov is updated upward and downward with different update rates, which can prevent the background noise frame SNR long term moving average $snr_n$_mov from being affected by a sudden change, so as to make the background noise frame SNR long term moving average $snr_n$_mov more stable. According to an embodiment of the present invention, before the update rate of the background noise related long term parameter updated by the SNR snr of the current background noise frame may include the long term moving average $snr_n$_mov, the SNR snr of the current background noise frame may be limited to a range as preset, for example, when the SNR snr of the current background noise frame is smaller than 10, the SNR snr of the current background noise frame is limited to 10.

Figure 4:
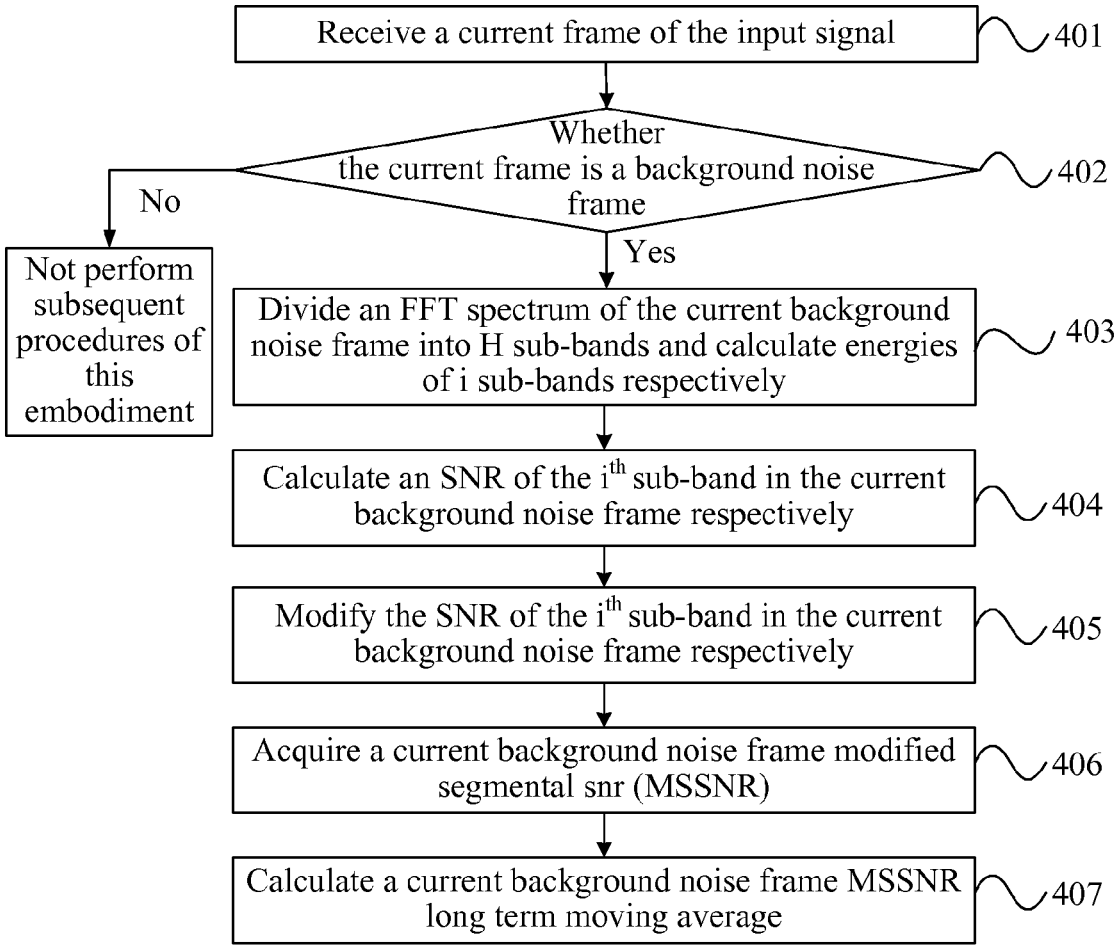
FIG. 4 is a flow chart of yet another embodiment of acquiring the fluctuant feature value of the background noise according to the present invention.

According to yet another embodiment of the method for VAD of the present invention, a background noise frame long modified segmental SNR (MSSNR) long term moving average $flux_{bgd}$ may be used as the fluctuant feature value of the background noise to represent the fluctuation of the background noise. FIG. 4 is a flow chart of yet another embodiment of acquiring the fluctuant feature value of the background noise according to the present invention. In this embodiment, the fluctuant feature value of the background noise is specifically the background noise frame MSSNR long term moving average $flux_{bgd}$. As shown in FIG. 4, the process according to this embodiment includes the following steps:

Step 401: Receive a current frame of the input signal.

Step 402: Decide whether the current frame is a background noise frame according to the VAD decision criterion. If the current frame is a background noise frame, perform step 403; if the current frame is not a background noise frame, do not perform subsequent procedures of this embodiment.

Step 403: divide a Fast Fourier Transform (FFT) spectrum of the current background noise frame into H sub-bands, in which H is an integer greater than 1, and calculate energies of i sub-bands $E_{band}(i)$, i=0, 1, . . . , H−1 respectively by using the formula $$E_{band}(i) = \frac{p}{h(i) - l(i) + 1} \sum_{j=1(i)}^{h(i)} S_j + (1 - p)E_{band_old}(i),$$

in which l(i) and h(i) represent an FFT frequency point with the lowest frequency and an FFT frequency point with the highest frequency in an $i^{th}$ sub-band respectively, $S_j$ represents an energy of a $j^{th}$ frequency point on the FFT spectrum, $E_{band_old}(i)$ represents an energy of the $i^{th}$ sub-band in a previous frame of the current background noise frame, and P is a preset constant.

In an embodiment, the value of P is 0.55. As a specific application instance of the present invention, the value of H may be 16.

Step 404: Calculate an SNR snr(i) of the $i^{th}$ sub-band in the current background noise frame respectively by using the formula $$snr(i)=10\log(E_{band}(i)/\overline{E_{band_n}(i)}),$$

$\overline{E_{band_n}(i)}$ is a background noise long term moving average, which can be specifically acquired by updating the background noise long term moving average $\overline{E_{band_n}(i)}$ using the energy of the $i^{th}$ sub-band in a previous background noise frame by using the formula $\overline{E_{band_n}(i)}=q\cdot\overline{E_{band_n}(i)}+(1-q)\cdot E_{band}(i)$, in which q is a preset constant.

In an embodiment, the value of q is 0.95.

Step 405: Modify the SNR snr(i) of the $i^{th}$ sub-band in the current background noise frame respectively by using the formula:

$$msnr(i) = \begin{cases} \mathrm{MAX}\left[\mathrm{MIN}\left[\frac{snr(i)^3}{C1}, 1\right], 0\right], i \in \text{ first set} \\ \mathrm{MAX}\left[\mathrm{MIN}\left[\frac{snr(i)^3}{C2}, 1\right], 0\right], i \in \text{ second set} \end{cases},$$

in which msnr(i) is the SNR of the $i^{th}$ sub-band modified, C1 and C2 are preset real constants greater than 0, and values in the first set and the second set form a set [0, H−1].

Step 406: Acquire a current background noise frame MSSNR by using the formula $$MSSNR = \sum_{i=0}^{H-1} msnr(i).$$

Step 407: Calculate a current background noise frame MSSNR long term moving average $flux_{bgd}$ by using the formula:

$flux_{bgd}=r\cdot flux_{bgd}+(1-r)\cdot MSSNR$, in which r is a forgetting coefficient for controlling an update rate of the current background noise frame MSSNR long term moving average $flux_{bgd}$.

In an embodiment, the value of r may be specifically set in the following ways: in a preset initial period from a first frame of the input signal and when MSSNR>$flux_{bgd}$, r=0.955; in the preset initial period from the first frame of the input signal and when MSSNR≦$flux_{bgd}$, r=0.995; after the preset initial period from the first frame of the input signal and when MSSNR>$flux_{bgd}$, r=0.997; and after the preset initial period from the first frame of the input signal and when MSSNR≦$flux_{bgd}$, r=0.9997.

Corresponding to the embodiment shown in FIG. 4, when the VAD decision criterion related parameter includes the primary decision threshold, according to an embodiment of the present invention, step 102 can be specifically implemented in the following ways:

A mapping between a fluctuant feature value and a decision threshold noise fluctuation bias thr_bias_noise is queried, and a decision threshold noise fluctuation bias thr_bias_noise corresponding to the fluctuant feature value of the background noise is acquired, in which the decision threshold noise fluctuation bias thr_bias_noise is used to represent a threshold bias value under a background noise with different fluctuation, and the mapping may be set previously or currently, or may be acquired from other network entities.

A VAD primary decision threshold vad_thr is acquired by using the formula vad_thr=$f_1$(snr)+$f_2$(snr)·thr_bias_noise, in which $f_1$(snr) is a reference threshold corresponding to an SNR snr of a current background noise frame, and $f_2$(snr) is a weighting coefficient of the decision threshold noise fluctuation bias thr_bias_noise corresponding to the SNR snr of the current background noise frame. Specifically, a function form of $f_1$(snr) and $f_2$(snr) to snr may be set according to empirical value.

The primary decision threshold in the VAD decision criterion related parameter is updated to the acquired primary decision threshold vad_thr.

In addition, corresponding to the embodiment shown in FIG. 4, when the VAD decision criterion related parameter includes the primary decision threshold, according to another embodiment of the present invention, step 102 can be specifically implemented in the following ways.

A fluctuation level flux_idx corresponding to the current background noise frame MSSNR long term moving average $flux_{bgd}$ is acquired, and an SNR level snr_idx corresponding to the SNR snr of the current background noise frame is acquired.

A primary decision threshold thr_tbl[snr_idx][flux_idx] corresponding to the acquired fluctuation level flux_idx and the SNR level snr_idx simultaneously is queried.

The primary decision threshold in the decision criterion related parameter is updated to the queried primary decision threshold thr_tbl[snr_idx][flux_idx].

After the current background noise frame MSSNR long term moving average $flux_{bgd}$ and the SNR snr correspond to corresponding levels, the apparatus for VAD only needs to store the mapping between the fluctuation level, the SNR level, and the primary decision threshold. Data amount of the fluctuation level and the SNR level is much smaller than the $flux_{bgd}$ and snr data that can be covered, so as to reduce the storage space of the apparatus for VAD occupied by the mapping greatly and use the storage space efficiently.

For example, the current background noise frame MSSNR long term moving average $flux_{bgd}$ may be divided into three fluctuation levels according to values, in which flux_idx represents the fluctuation level of $flux_{bgd}$, and flux_idx may be set to 0, 1, and 2, representing low fluctuation, medium fluctuation, and high fluctuation, respectively. According to an embodiment, the value of the flux_idx is determined in the following ways:

If $flux_{bgd}$<3.5, flux_idx=0.

If 3.5<=$flux_{bgd}$<6, flux_idx=1.

If $flux_{bgd}$>=6, flux_idx=2.

Likewise, a signal long term current background noise frame SNR snr is divided into four SNR levels according to values, in which snr_idx represents an SNR level of snr, and snr_idx may be set to 0, 1, 2, and 3 to represent low SNR, medium SNR, high SNR, and higher SNR, respectively.

Further, the fluctuation level flux_idx corresponding to the current background noise frame MSSNR long term moving average $flux_{bgd}$ is acquired, and a decision tendency op_idx corresponding to current working performance of the apparatus for VAD performing VAD decision on the input signal may also be acquired when the SNR level snr_idx corresponding to the SNR of the current background noise frame, that is, it is prone to decide that the current frame is a voice frame or a background noise frame. Specifically, the current working performance of the apparatus for VAD may include saving bandwidth by the voice encoding quality after VAD startup and the VAD. Correspondingly, a primary decision threshold vad_thr=thr_tbl[snr_idx][flux_idx][op_idx] corresponding to the fluctuation level flux_idx, the SNR level snr_idx, and the performance level op_idx may be queried, and the primary decision threshold in the VAD decision criterion related parameter is updated to the primary decision threshold vad_thr=thr_tbl[snr_idx][flux_idx][op_idx].

Adaptive update is further performed on the primary decision threshold in the VAD decision criterion related parameter in combination with the decision tendency corresponding to the current working performance of the apparatus for VAD, so as to make the VAD decision criterion more applicable to a specific apparatus for VAD, thereby acquiring higher VAD decision performance more applicable to a specific environment, further improving the VAD decision efficiency and decision accuracy, and increasing utilization of limited channel bandwidth resources.

Figure 5:
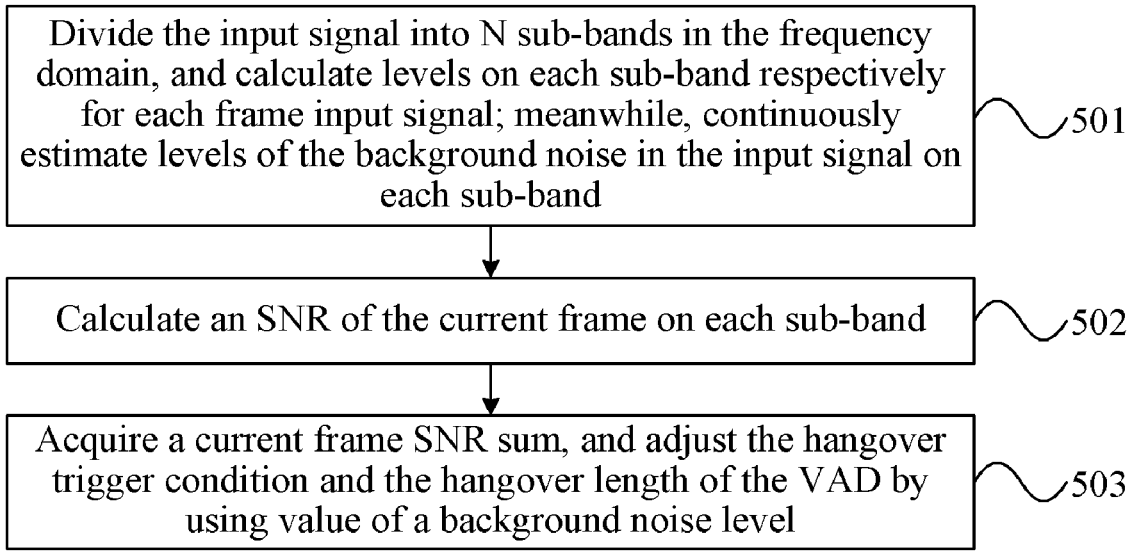
FIG. 5 is a flow chart of an embodiment of dynamically adjusting a VAD decision criterion related parameter according to a level of the background noise according to the present invention.

In the method for VAD according to the embodiments of the present invention, any one or more VAD decision criterion related parameters: the primary decision threshold, the hangover length, and the hangover trigger condition may further be dynamically adjusted according to the level of the background noise in the input signal. FIG. 5 is a flow chart of an embodiment of dynamically adjusting a VAD decision criterion related parameter according to a level of the background noise according to the present invention, and this embodiment may be specifically implemented by an AMR. As shown in FIG. 5, the process includes the following steps:

Step 501: Divide the input signal into N sub-bands in the frequency domain, and calculate levels level(i) (in which i=0, 1, 2 . . . N−1) on each sub-band respectively for each frame input signal. Meanwhile, levels bckr_level(i) (in which i=0, 1, 2 . . . N−1) of the background noise in the input signal on each sub-band are continuously estimated.

$$\text{noise_level} = \frac{1}{N}\sum_{i=0}^{N-1} \text{bckr_level}(i)$$

represents the level of the current background noise frame.

Step 502: Calculate an SNR snr(i) of the current frame on each sub-band by using the formula $$\text{snr}(i)=\text{level}(i)^2/\text{bckr_level}(i)^2.$$

Step 503: Acquire a current frame SNR sum snr_sum by using the formula $$\text{snr_sum} = \sum snr(i),$$

and the current frame SNR sum snr_sum is the primary decision parameter of the VAD. Meanwhile, the hangover trigger condition and the hangover length of the VAD are adjusted according to a background noise level noise_level.

A medium decision result (or called a first decision result) of the VAD may be acquired by comparing the current frame SNR sum snr_sum with a preset decision threshold vad_thr. Specifically, if the current frame SNR sum snr_sum is greater than the decision threshold vad_thr, the medium decision result of the VAD is 1, that is, the current frame is decided to be a voice frame; if the current frame SNR sum snr_sum is smaller than or equal to the decision threshold vad_thr, the medium decision result of the VAD is 0, that is, the current frame is decided to be a background noise frame.

The decision threshold vad_thr is controlled by the background noise level noise_level, which is specifically decided by using the formula $$vad_thr=[(VAD_THR_HIGH-VAD_THR_LOW)/(p2-p1)]\cdot(noise_level-p1)+VAD_THR_HIGH,$$

in which VAD_THR_HIGH and VAD_THR_LOW are upper and lower limits of a value range of the decision threshold vad_thr respectively, and p2 and p1 represent background noise levels corresponding to the upper and lower limits of the decision threshold vad_thr respectively.

It is thus evident that, the decision threshold vad_thr is interpolated between the upper and lower limits according to the value of the background noise level noise_level, and is in a linear relation with the noise_level. The higher the background noise level noise_level is, the lower the decision threshold thr_vad is, so that a sufficient VAD accuracy can also be ensured in the case of a larger background noise.

The hangover trigger condition of the VAD is also controlled by the background noise level noise_level. The so-called hangover trigger condition means that the hangover counter may be set to be a hangover maximum length when the hangover trigger condition is satisfied. When the medium decision result is 0, whether a hangover is made is determined according to whether the hangover counter is greater than 0. If the hangover counter is greater than 0, a final output of the VAD is changed from 0 into 1 and the hangover counter subtracts 1; if the hangover counter is smaller than or equal to 0, the final output of the VAD is kept as 0. In the VAD of the AMR, the hangover trigger condition is whether the number N of present successive voice frames is greater than a preset threshold. If the number N of present successive voice frames is greater than the preset threshold, the hangover trigger condition is satisfied and the hangover counter is reset. When the noise_level is greater than another preset threshold, it is considered that the current background noise is larger, and N in the trigger condition is set to be a smaller value, so as to enable easier occurrence of the hangover. Otherwise, when the noise_level is not greater than the another preset threshold, it is considered that the current background noise is smaller, and N is set to be a larger value, which makes occurrence of the hangover difficult.

Moreover, the hangover maximum length, that is, the maximum value of the hangover counter, is also controlled by the background noise level noise_level. When the background noise level noise_level is greater than another preset threshold, it is considered that the background noise is larger, and when a hangover is triggered, the hangover counter may be set to be a larger value. Otherwise, when the background noise level noise_level is not greater than the further preset threshold, it is considered that the background noise is smaller, and when a hangover is triggered, the hangover counter may be set to be a smaller value.

Figure 6:
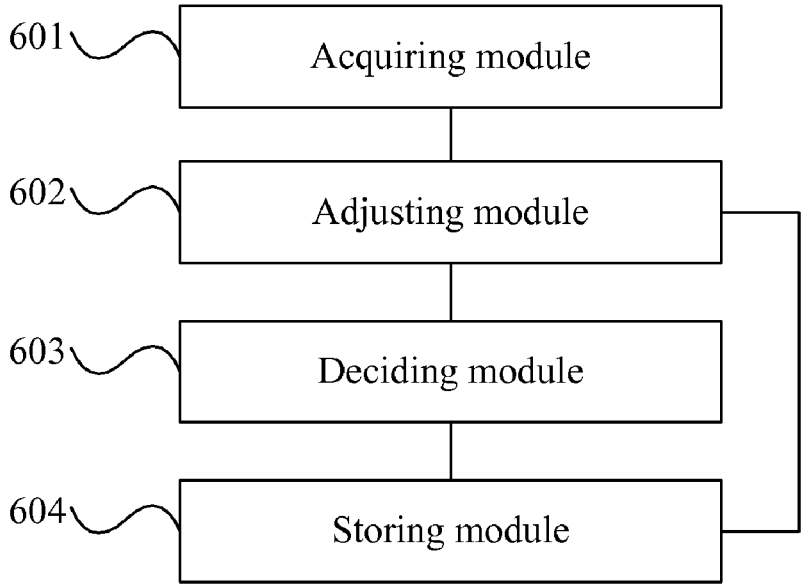
FIG. 6 is a schematic structural view of a first embodiment of an apparatus for VAD according to the present invention.

FIG. 6 is a schematic structural view of a first embodiment of an apparatus for VAD according to the present invention. The apparatus for VAD according to this embodiment may be configured to implement the method for VAD according to the embodiments of the present invention. As shown in FIG. 6, the apparatus for VAD according to this embodiment includes an acquiring module 601, an adjusting module 602, and a deciding module 603.

The acquiring module 601 is configured to acquire a fluctuant feature value of a background noise when an input signal is the background noise, in which the fluctuant feature value is used to represent fluctuation of the background noise. The adjusting module 602 is configured to perform adaptive adjustment on a VAD decision criterion related parameter according to the fluctuant feature value acquired by the acquiring module 601. The deciding module 603 is configured to perform VAD decision on the input signal by using the decision criterion related parameter on which the adaptive adjustment is performed by the adjusting module 602.

Further, referring to FIG. 6, the apparatus for VAD according to this embodiment of the present invention may also include a storing module 604, configured to store the VAD decision criterion related parameter, in which the decision criterion related parameter may include any one or more of a primary decision threshold, a hangover trigger condition, a hangover length, and an update rate of an update rate of a long term parameter related to background noise. Correspondingly, the adjusting module 602 is configured to perform adaptive adjustment on the VAD decision criterion related parameter stored in the storing module 604; and the deciding module 603 performs VAD decision on the input signal by using the decision criterion related parameter stored in the storing module 604 on which the adaptive adjustment is performed.

Figure 7:
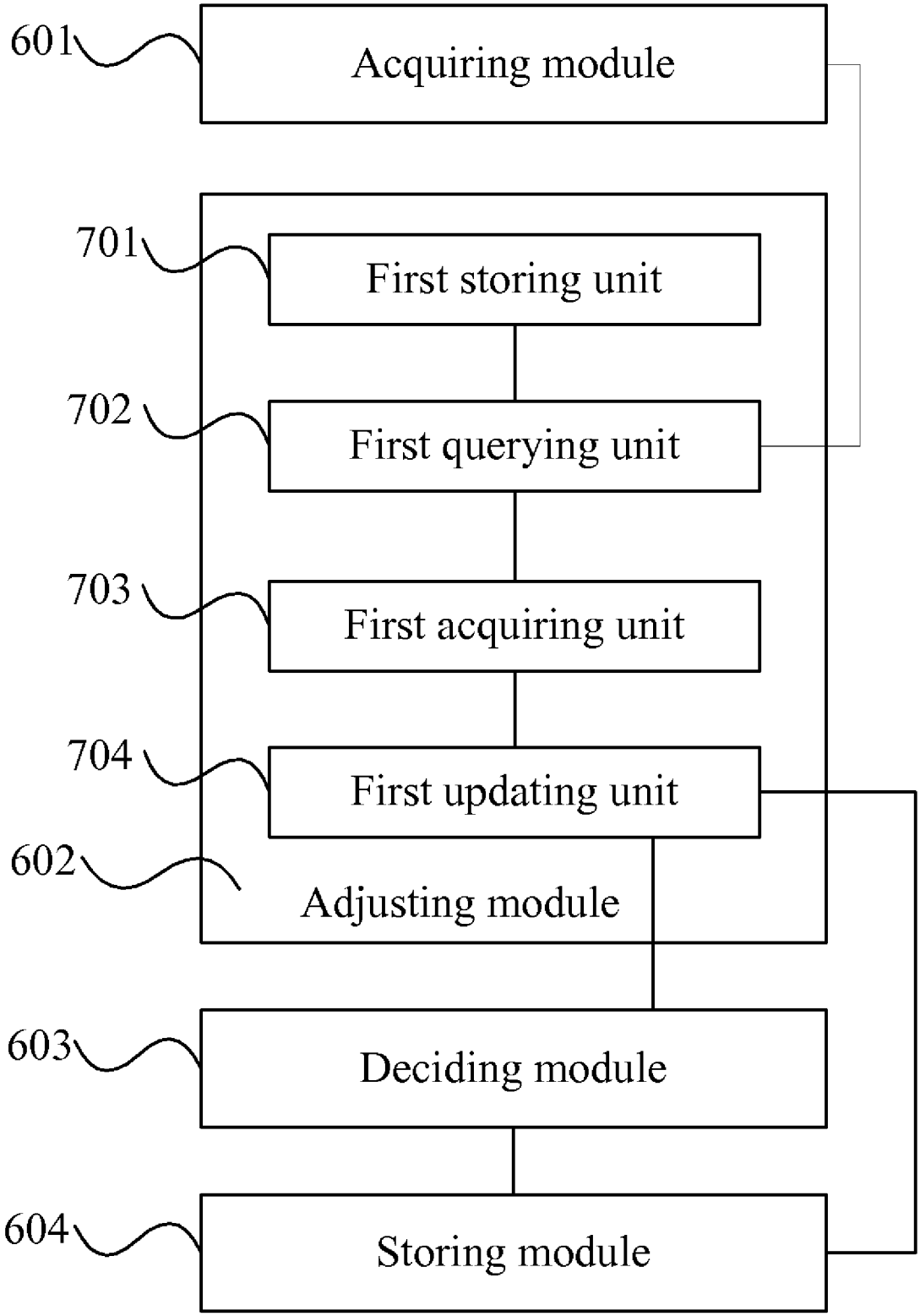
FIG. 7 is a schematic structural view of a second embodiment of the apparatus for VAD according to the present invention.

FIG. 7 is a schematic structural view of a second embodiment of the apparatus for VAD according to the present invention. Compared with the embodiment shown in FIG. 6, in the apparatus for VAD according to this embodiment, when the VAD decision criterion related parameter includes the primary decision threshold, the adjusting module 602 includes a first storing unit 701, a first querying unit 702, a first acquiring unit 703, and a first updating unit 704. The first storing unit 701 is configured to store a mapping between a fluctuant feature value and a decision threshold noise fluctuation bias thr_bias_noise. The first querying unit 702 is configured to query the mapping between the fluctuant feature value and the decision threshold noise fluctuation bias thr_bias_noise from the first storing unit 701, and acquire a decision threshold noise fluctuation bias thr_bias_noise corresponding to a fluctuant feature value of a background noise, in which the decision threshold noise fluctuation bias thr_bias_noise is used to represent a threshold bias value under a background noise with different fluctuation. The first acquiring unit 703 is configured to acquire a primary decision threshold vad_thr by using the formula $vad_thr=f_1(snr)+f_2(snr)\cdot thr_bias_noise$, in which $f_1(snr)$ is a reference threshold corresponding to an SNR snr of a current background noise frame, and $f_2(snr)$ is a weighting coefficient of the decision threshold noise fluctuation bias thr_bias_noise corresponding to the SNR snr of the current background noise frame. The first updating unit 704 is configured to update the primary decision threshold in the VAD decision criterion related parameter to the primary decision threshold vad_thr acquired by the first acquiring unit 703.

Figure 8:
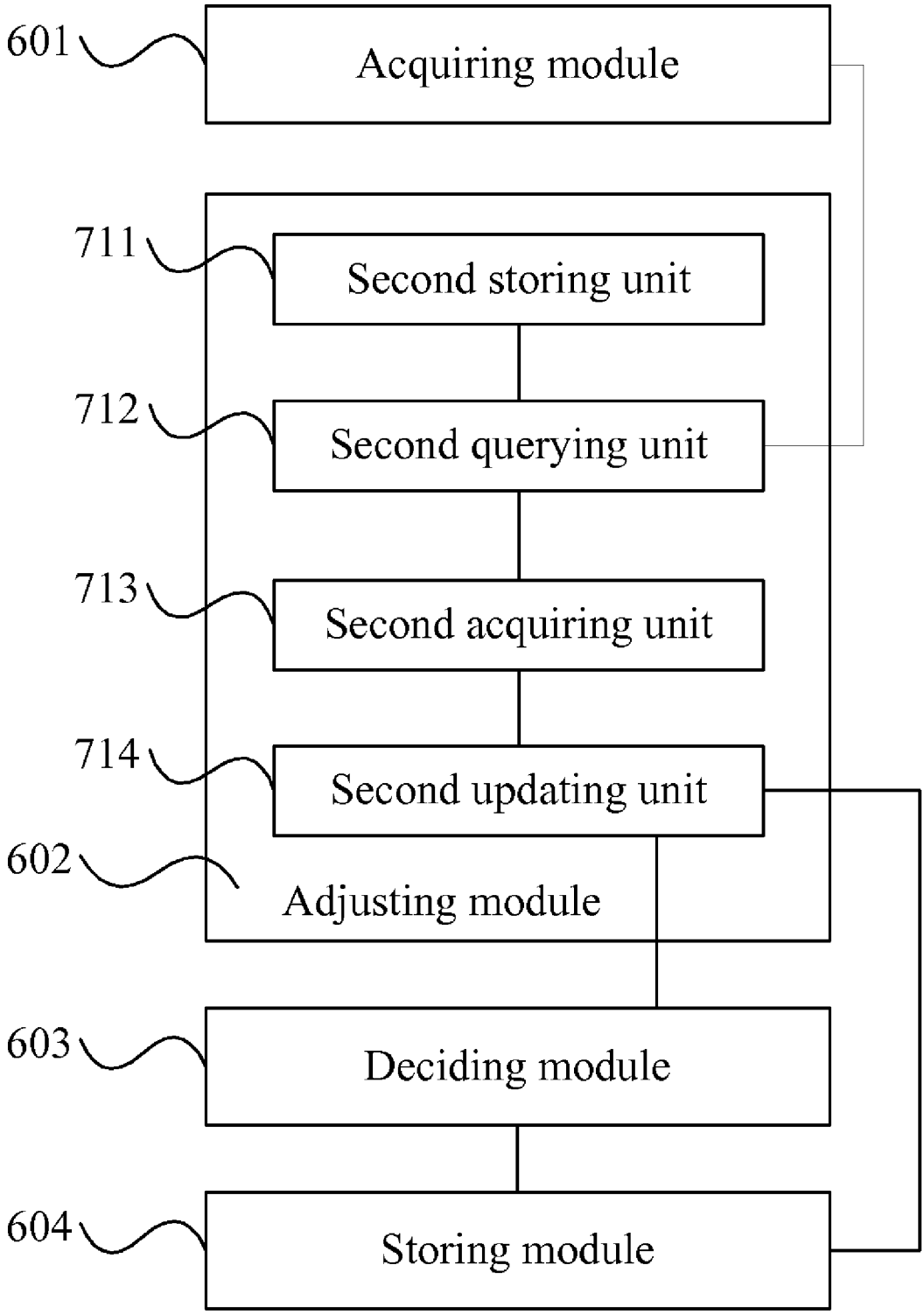
FIG. 8 is a schematic structural view of a third embodiment of the apparatus for VAD according to the present invention.

FIG. 8 is a schematic structural view of a third embodiment of the apparatus for VAD according to the present invention. Compared with the embodiment shown in FIG. 6, in the apparatus for VAD according to this embodiment, when the VAD decision criterion related parameter includes the hangover trigger condition, the adjusting module 602 includes a second storing module 711, a second querying unit 712, a second acquiring unit 713, and a second updating unit 714. The second storing module 711 is configured to store a successive-voice-frame length fluctuation mapping table burst_cnt_noise_tbl[ ] and a determined voice threshold fluctuation bias value table burst_thr_noise_tbl[ ], in which the successive-voice-frame length fluctuation mapping table burst_cnt_noise_tbl[ ] includes a mapping between a fluctuant feature value and a successive-voice-frame length, and the determined voice threshold fluctuation bias value table burst_thr_noise_tbl[ ] includes a mapping between a fluctuant feature value and a determined voice threshold. The second querying unit 712 is configured to query a successive-voice-frame length burst_cnt_noise_tbl[fluctuant feature value] corresponding to the fluctuant feature value of the background noise from the successive-voice-frame length noise fluctuation mapping table burst_cnt_noise_tbl[ ] stored by the second storing unit 711, and query a determined voice threshold burst_thr_noise_tbl[fluctuant feature value] corresponding to the fluctuant feature value of the background noise from the threshold bias table of determined voice according to noise fluctuation burst_thr_noise_tbl[ ]. The second acquiring unit 713 is configured to acquire a successive-voice-frame quantity threshold M by using the formula $M=f_3(snr)+f_4(snr)\cdot$ burst_cnt_noise_tbl[fluctuant feature value], and acquire a determined voice frame threshold burst_thr by using the formula burst_thr$=f_5$ (snr)$+f_6(snr)\cdot$burst_thr_noise_tbl[fluctuant feature value], in which $f_3(snr)$ is a reference quantity threshold corresponding to the SNR snr of the current background noise frame, $f_4(snr)$ is a weighting coefficient of the successive-voice-frame length burst_cnt_noise_tbl[fluctuant feature value] corresponding to the SNR snr of the current background noise frame, $f_5(snr)$ is a reference voice frame threshold corresponding to the SNR snr of the current background noise frame, and $f_6(snr)$ is a weighting coefficient of the determined voice threshold burst_thr_noise_tbl[fluctuant feature value] corresponding to the SNR snr of the current background noise frame. The second updating unit 714 is configured to update the hangover trigger condition in the VAD decision criterion related parameter according to the successive-voice-frame quantity threshold M and determined voice frame threshold burst_thr acquired by the second acquiring unit 713.

Figure 9:
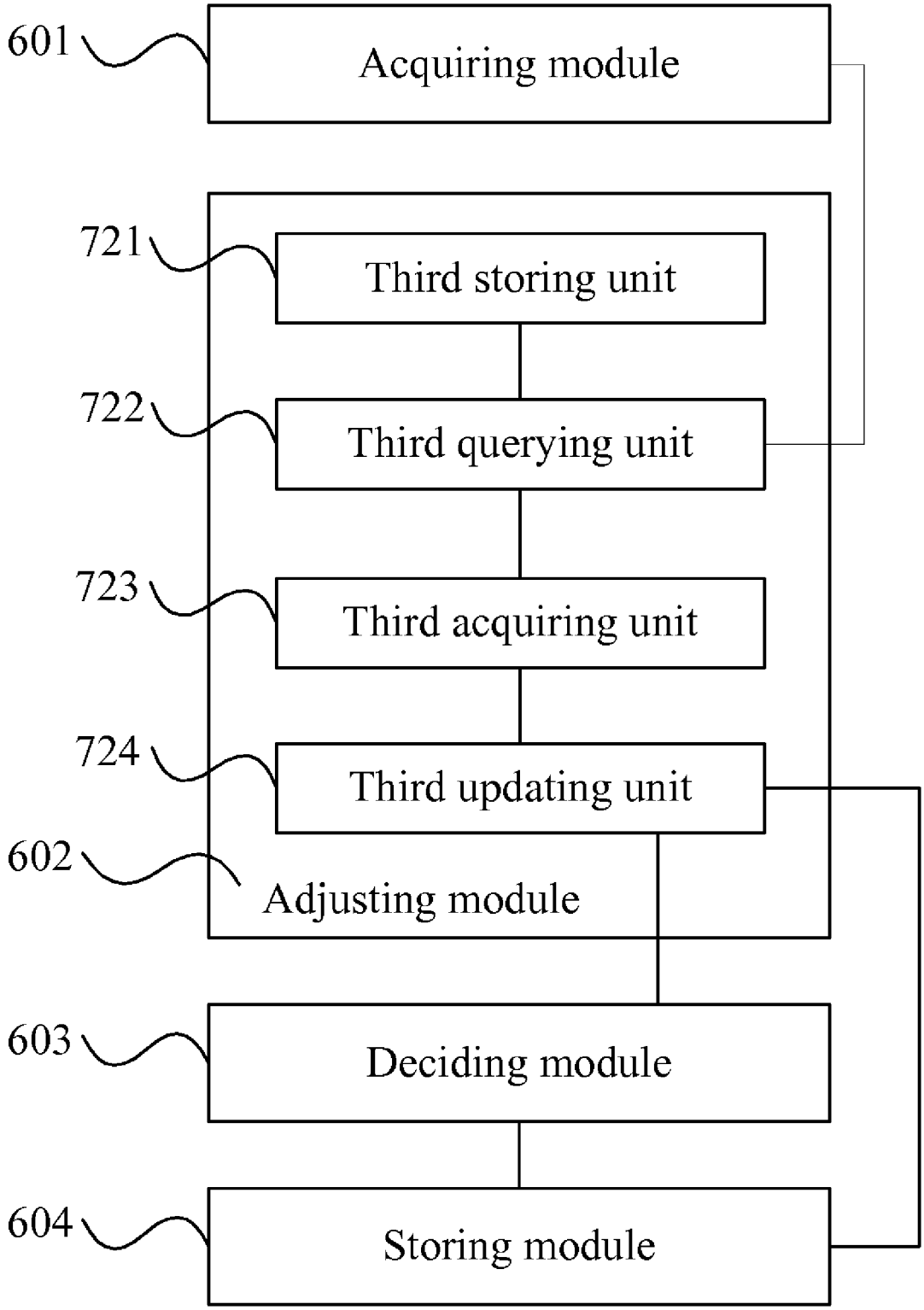
FIG. 9 is a schematic structural view of a fourth embodiment of the apparatus for VAD according to the present invention.

FIG. 9 is a schematic structural view of a fourth embodiment of the apparatus for VAD according to the present invention. Compared with the embodiment shown in FIG. 6, in the apparatus for VAD according to this embodiment, when the VAD decision criterion related parameter includes the hangover trigger condition, the adjusting module 602 includes a third storing unit 721, a third querying unit 722, a third acquiring unit 723, and a third updating unit 724. The third storing unit 721 is configured to store a hangover length noise fluctuation mapping table hangover_noise_tbl[ ], in which the hangover length noise fluctuation mapping table hangover_noise_tbl[ ] includes a mapping between a fluctuant feature value and a hangover length. The third querying unit 722 is configured to query a hangover length hangover_nosie_tbl [fluctuant feature value] corresponding to the fluctuant feature value of the background noise from the hangover length noise fluctuation mapping table hangover_noise_tbl[ ] stored by the third storing unit 721. The third acquiring unit 723 is configured to acquire a hangover counter reset maximum value hangover_max by using the formula hangover_max$=f_7$ (snr)$+f_8(snr)\cdot$hangover_noise_tbl[fluctuant feature value], in which $f_7(snr)$ is a reference reset value corresponding to the SNR snr of the current background noise frame, and $f_8(snr)$ is a weighting coefficient of the hangover length hangover_nosie_tbl[idx] corresponding to the SNR snr of the current background noise frame. The third updating unit 724 is configured to update the hangover length in the VAD decision criterion related parameter to the calculated hangover counter reset maximum value hangover_max acquired by the third acquiring unit 723.

Figure 10:
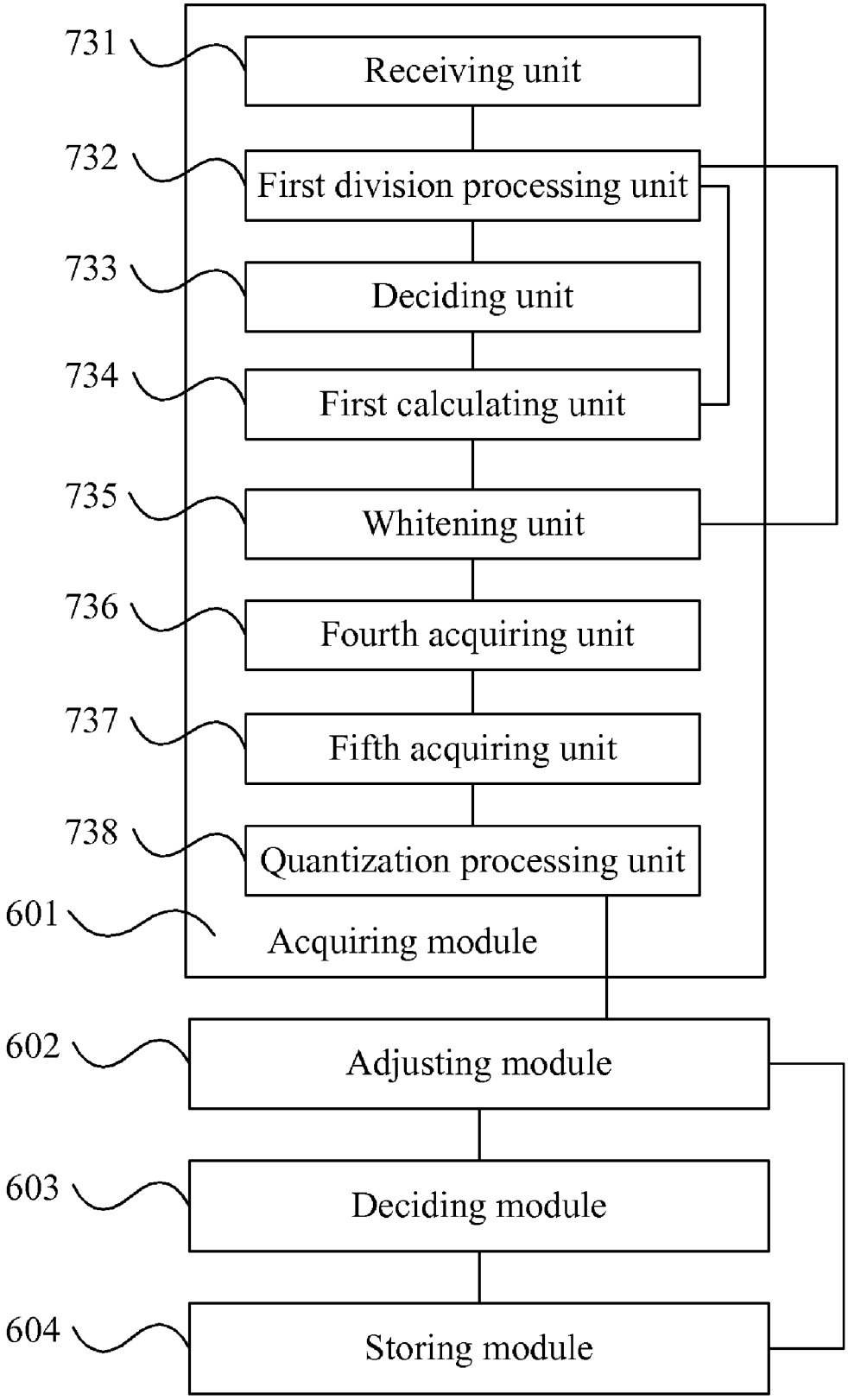
FIG. 10 is a schematic structural view of a fifth embodiment of the apparatus for VAD according to the present invention.

FIG. 10 is a schematic structural view of a fifth embodiment of the apparatus for VAD according to the present invention. The apparatus for VAD according to this embodiment may be configured to implement the method for VAD of the embodiment shown in FIG. 2 of the present invention. In this embodiment, the fluctuant feature value is specifically a quantized value idx of the long term moving average hb_noise_mov of a whitened background noise spectral entropy. Correspondingly, the acquiring module 601 includes a receiving unit 731, a first division processing unit 732, a deciding unit 733, a first calculating unit 734, a whitening unit 735, a fourth acquiring unit 736, a fifth acquiring unit 737, and a quantization processing unit 738. The receiving unit 731 is configured to receive a current frame of the input signal. The first division processing unit 732 is configured to divide the current frame of the input signal received by the receiving unit 731 into N sub-bands in a frequency domain, in which N is an integer greater than 1, and energies enrg(i) (in which i=0, 1, . . . , N−1) of the N sub-bands are calculated respectively. The deciding unit 733 is configured to decide whether the current frame of the input signal received by the receiving unit 731 is a background noise frame according to the VAD decision criterion. The first calculating unit 734 is configured to calculate a long term moving average energy enrg_n(i) of the background noise frame respectively on the N sub-bands by using the formula enrg_n(i)$=\alpha\cdot$enrg_n$+(1-\alpha)\cdot$enrg(i) when the current frame is a background noise frame, in which $\alpha$ is a forgetting coefficient for controlling an update rate of the long term moving average energy enrg_n(i) of the background noise frame respectively on the N sub-bands, and enrg_n is an energy of the background noise frame. The whitening unit 735 is configured to whiten a spectrum of the current background noise frame by using the formula enrg_w(i)=enrg(i)/enrg_n(i), and acquire an energy enrg_w(i) of the whitened background noise on an $i^{th}$ sub-band. The fourth acquiring unit 736 is configured to acquire a whitened background noise spectral entropy hb by using the formula $$hb = -\sum_{i=0}^{N-1} p_i \cdot \log p_i,$$

in which $$p_i = \text{enrg_w}(i) \Big/ \sum_{i=0}^{N-1} \text{enrg_w}(i).$$

The fifth acquiring unit 737 is configured to acquire a long term moving average hb_noise_mov of a whitened background noise spectral entropy by using the formula hb_noise_mov$=\beta\cdot$hb_noise_mov$+(1-\beta)\cdot$hb, in which $\beta$ is a forgetting factor for controlling an update rate of the long term moving average hb_noise_mov of a whitened background noise spectral entropy. The quantization processing unit 738 is configured to quantize the long term moving average hb_noise_mov of a whitened background noise spectral entropy by using the formula idx=|(hb_noise_mov−A)/B|, so as to acquire a quantized value idx, in which A and B are preset values, and may be empirical values selected according to actual demands.

Figure 11:
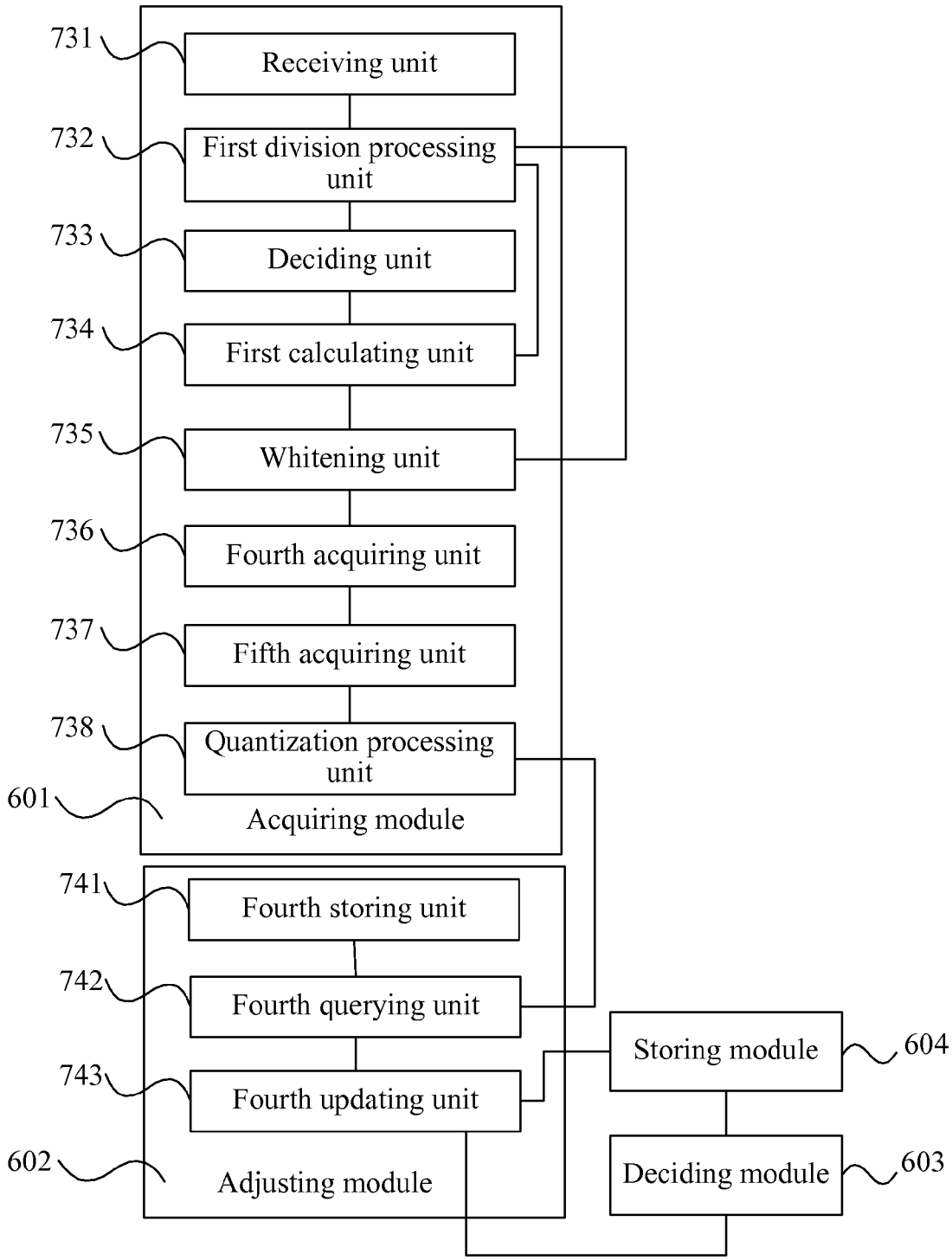
FIG. 11 is a schematic structural view of a sixth embodiment of the apparatus for VAD according to the present invention.

FIG. 11 is a schematic structural view of a sixth embodiment of the apparatus for VAD according to the present invention. When an update rate of the background noise related long term parameter includes the update rate of a long term moving average energy enrg_n(i) of the background noise, compared with the embodiment shown in FIG. 10, in the apparatus for VAD according to this embodiment, the adjusting module 602 includes a fourth storing unit 741, a fourth querying unit 742, and a fourth updating unit 743. The fourth storing unit 741 is configured to store a background noise update rate table alpha_tbl[ ], in which the background noise update rate table alpha_tbl[ ] includes a mapping between the quantized value and the forgetting coefficient of the update rate of the long term moving average energy enrg_n(i). The fourth querying unit 742 is configured to query the background noise update rate table alpha_tbl[ ] from the fourth storing unit 741, and acquire a forgetting coefficient α of the update rate of the long term moving average energy enrg_n(i) corresponding to the quantized value idx of the background noise. The fourth updating unit 743 is configured to use the forgetting coefficient α acquired by the fourth querying unit 742 as a forgetting coefficient for controlling the update rate of the long term moving average energy enrg_n(i) of the background noise frame respectively on the N sub-bands.

Figure 12:
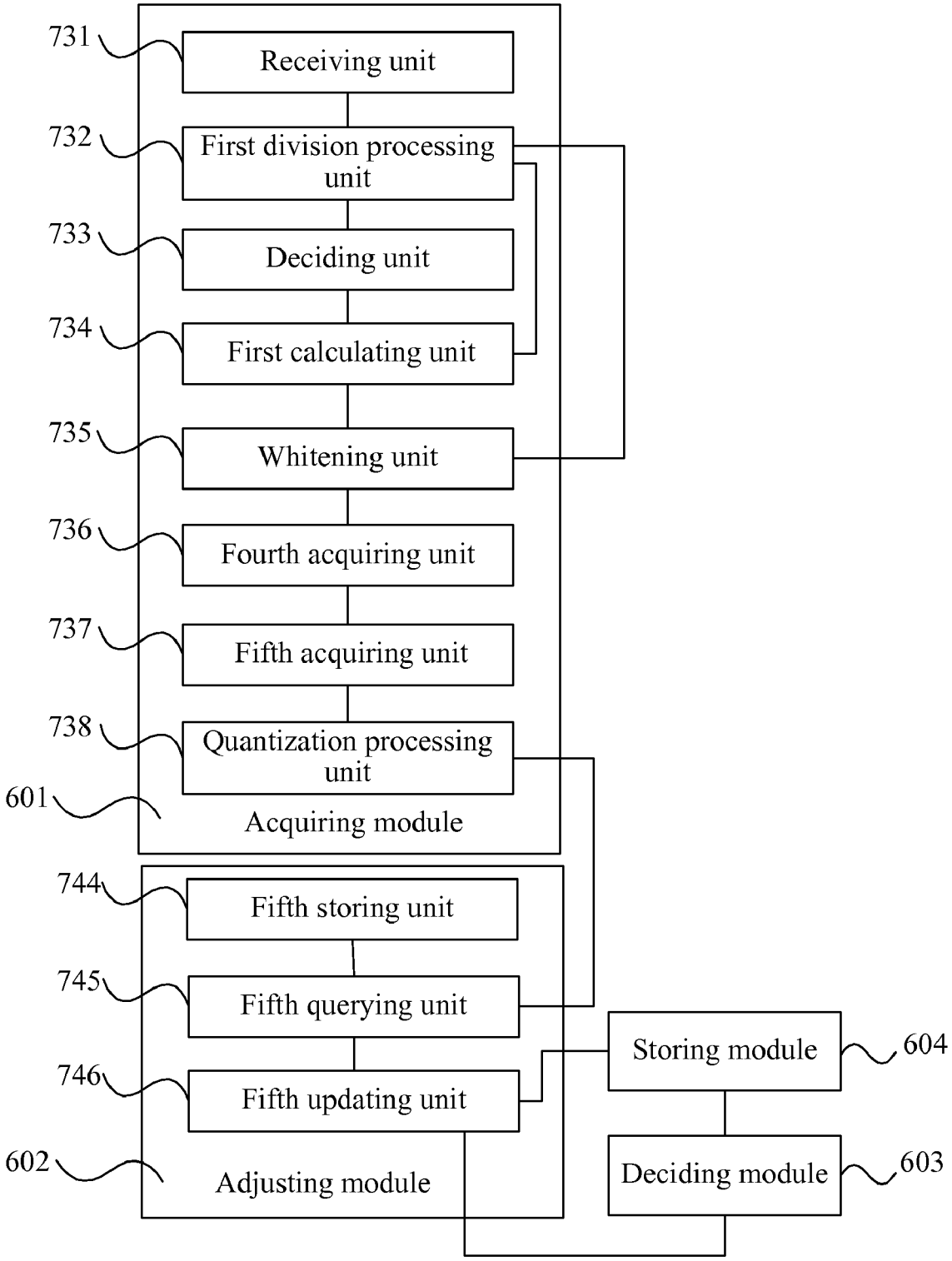
FIG. 12 is a schematic structural view of a seventh embodiment of the apparatus for VAD according to the present invention.

FIG. 12 is a schematic structural view of a seventh embodiment of the apparatus for VAD according to the present invention. When the update rate of the background noise related long term parameter includes an update rate of the long term moving average hb_noise_mov of a whitened background noise spectral entropy, compared with the embodiment shown in FIG. 10, in the apparatus for VAD according to this embodiment, the adjusting module 602 includes a fifth storing unit 744, a fifth querying unit 745, and a fifth updating unit 746. The fifth storing unit 744 is configured to store a background noise fluctuation update rate table beta_tbl[ ], in which the background noise fluctuation update rate table beta_tbl[ ] includes a mapping between the quantized value and the forgetting factor of the update rate of the long term moving average hb_noise_mov. The fifth querying unit 745 is configured to query the background noise fluctuation update rate table beta_tbl[ ] from the fifth storing unit 744, and acquire a forgetting factor β of the update rate of the long term moving average hb_noise_mov corresponding to the quantized value idx of the background noise. The fifth updating unit 746 is configured to use the forgetting factor β acquired by the fifth querying unit 745 as a forgetting factor for controlling the update rate of the long term moving average hb_noise_mov of a whitened background noise spectral entropy.

Figure 13:
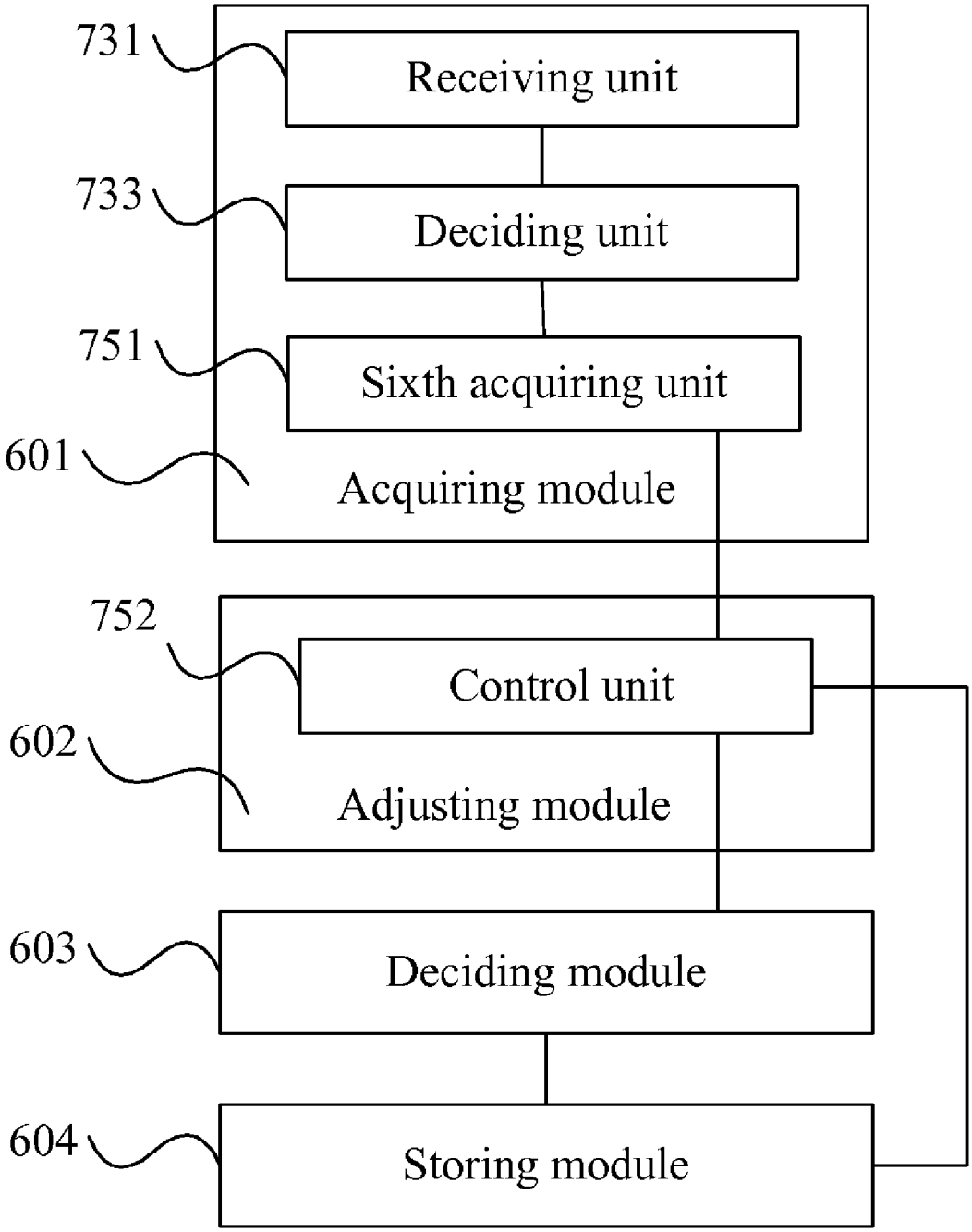
FIG. 13 is a schematic structural view of an eighth embodiment of the apparatus for VAD according to the present invention.

FIG. 13 is a schematic structural view of an eighth embodiment of the apparatus for VAD according to the present invention. The apparatus for VAD according to this embodiment can be configured to implement the method for VAD in the embodiment shown in FIG. 3 of the present invention. In this embodiment, the fluctuant feature value is specifically a background noise frame SNR long term moving average $snr_n$_mov. Correspondingly, the acquiring module 601 includes the receiving unit 731, the deciding unit 733, and a sixth acquiring unit 751. The receiving unit 731 is configured to receive a current frame of the input signal. The deciding unit 733 is configured to decide whether the current frame of the input signal received by the receiving unit 731 is a background noise frame according to the VAD decision criterion. The sixth acquiring unit 751 is configured to acquire a background noise frame SNR long term moving average $snr_n$_mov according a formula $snr_n_mov=k\cdot snr_n_mov+(1-k)\cdot snr$ according to a decision result of the deciding unit 733 when the current frame is a background noise frame, in which snr is an SNR of the current background noise frame, and k is a forgetting factor for controlling an update rate of the background noise frame SNR long term moving average $snr_n$_mov.

Further, referring to FIG. 13, when the update rate of the background noise related long term parameter includes the update rate of the long term moving average $snr_n$_mov, the adjusting module 602 may include a control unit 752, configured to set different values for the forgetting factor k for controlling the update rate of the background noise frame SNR long term moving average $snr_n$_mov when the SNR snr of the current background noise frame is greater than a mean $snr_n$ of SNRs of last n background noise frames and when the SNR snr of the current background noise frame is smaller than the mean $snr_n$ of SNRs of the last n background noise frames.

Figure 14:
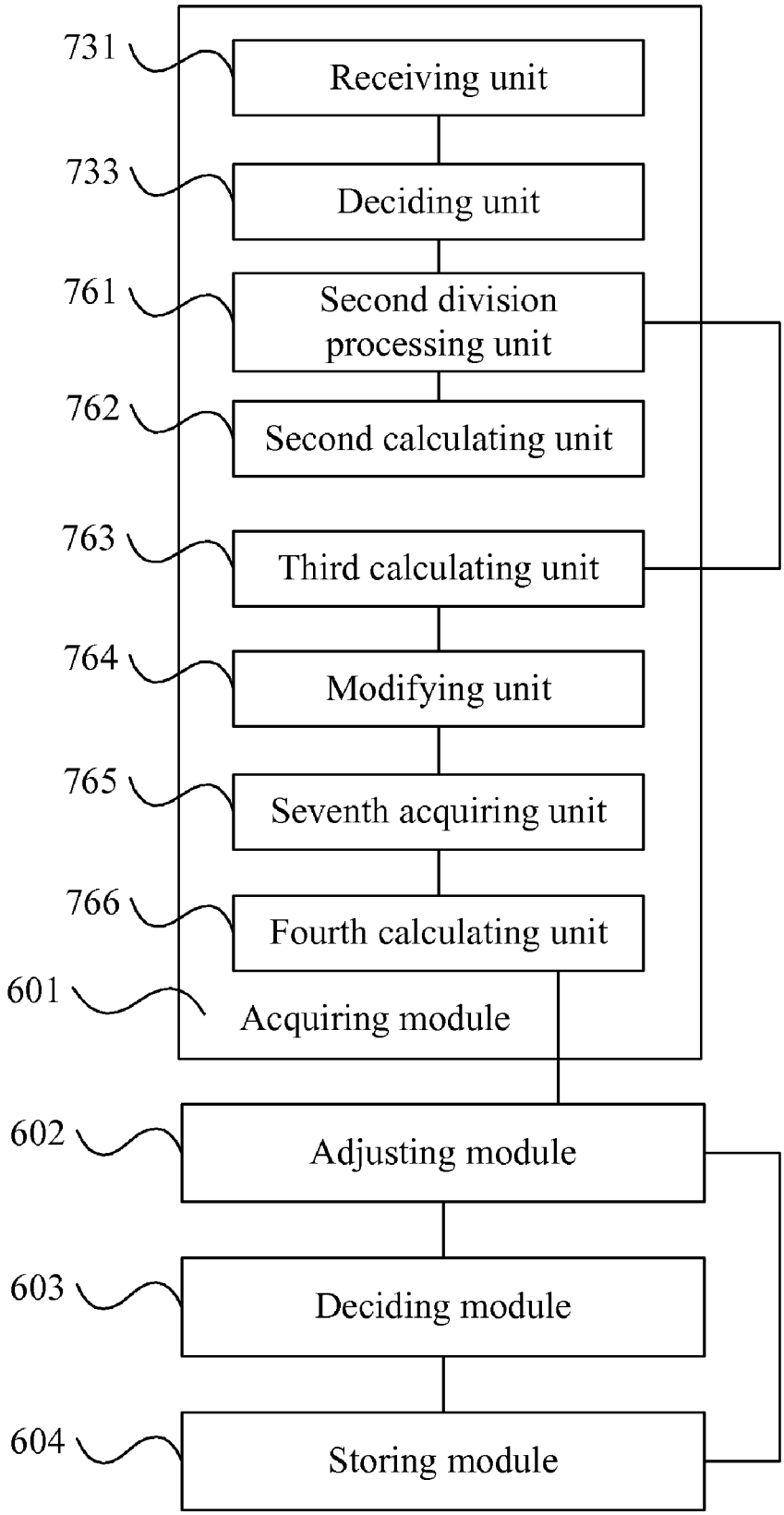
FIG. 14 is a schematic structural view of a ninth embodiment of the apparatus for VAD according to the present invention.

FIG. 14 is a schematic structural view of a ninth embodiment of the apparatus for VAD according to the present invention. The apparatus for VAD according to this embodiment can be configured to implement the method for VAD in the embodiment shown in FIG. 4 of the present invention. In this embodiment, the fluctuant feature value is specifically a background noise frame MSSNR long term moving average $flux_{bgd}$. Correspondingly, the acquiring module 601 includes the receiving unit 731, the deciding unit 733, a second division processing unit 761, a second calculating unit 762, a third calculating unit 763, a modifying unit 764, a seventh acquiring unit 765, and a fourth calculating unit 766. The receiving unit 731 is configured to receive a current frame of the input signal. The deciding unit 733 is configured to decide whether the current frame of the input signal received by the receiving unit 731 is a background noise frame according to the VAD decision criterion. The second division processing unit 761 is configured to divide the FFT spectrum of the current background noise frame into H sub-bands according to the decision result of the deciding unit 733 when the current frame is a background noise frame, in which H is an integer greater than 1, and calculate energies $E_{band}(i)$ (in which i=0, 1, . . . , H−1) of i sub-bands respectively by using the formula $$E_{band}(i) = \frac{p}{h(i) - l(i) + 1} \sum_{j=l(i)}^{h(i)} S_j + (1 - p)E_{band_old}(i),$$

in which l(i) and h(i) represent an FFT frequency point with the lowest frequency and an FFT frequency point with the highest frequency in an $i^{th}$ sub-band respectively, $S_j$ represents an energy of a $j^{th}$ frequency point on the FFT spectrum, $E_{band_old}(i)$ represents an energy of the $i^{th}$ sub-band in a previous frame of the current background noise frame, and P is a preset constant, which may be specifically set according to empirical values. The second calculating unit 762 is configured to update a background noise long term moving average $\overline{E_{band_n}(i)}$ using the energy of the $i^{th}$ sub-band in a previous background noise frame by using the formula $\overline{E_{band_n}(i)}=q\cdot\overline{E_{band_n}(i)}+(1-q)\cdot E_{band}(i)$ in which q is a preset constant and may be specifically set according to empirical values. The third calculating unit 763 is configured to calculate an SNR snr(i) of the $i^{th}$ sub-band in the current background noise frame respectively by using the formula $snr(i)=10\log(E_{band}(i)/\overline{E_{band}(i)})$. The modifying unit 764 is configured to modify the snr(i) of the $i^{th}$ sub-band in the current background noise frame respectively by using the formula $$msnr(i) = \begin{cases} \mathrm{MAX}\left[\mathrm{MIN}\left[\frac{snr(i)^3}{C1}, 1\right], 0\right], & i \in \text{first set} \\ \mathrm{MAX}\left[\mathrm{MIN}\left[\frac{snr(i)^3}{C2}, 1\right], 0\right], & i \in \text{second set} \end{cases},$$

in which msnr(i) is the SNR snr of the $i^{th}$ sub-band modified, C1 and C2 are preset real constants greater than 0, and values in the first set and the second set form a set [0, H−1]. The seventh acquiring unit 765 is configured to acquire a current background noise frame MSSNR by using the formula $$MSSNR = \sum_{i=0}^{H-1} msnr(i).$$

The fourth calculating unit 766 is configured to calculate a current background noise frame MSSNR long term moving average $flux_{bgd}$ by using the formula $flux_{bgd}=r \cdot flux_{bgd}(1-r) \cdot MSSNR$, in which r is a forgetting coefficient for controlling an update rate of the current background noise frame MSSNR long term moving average $flux_{bgd}$.

Figure 15:
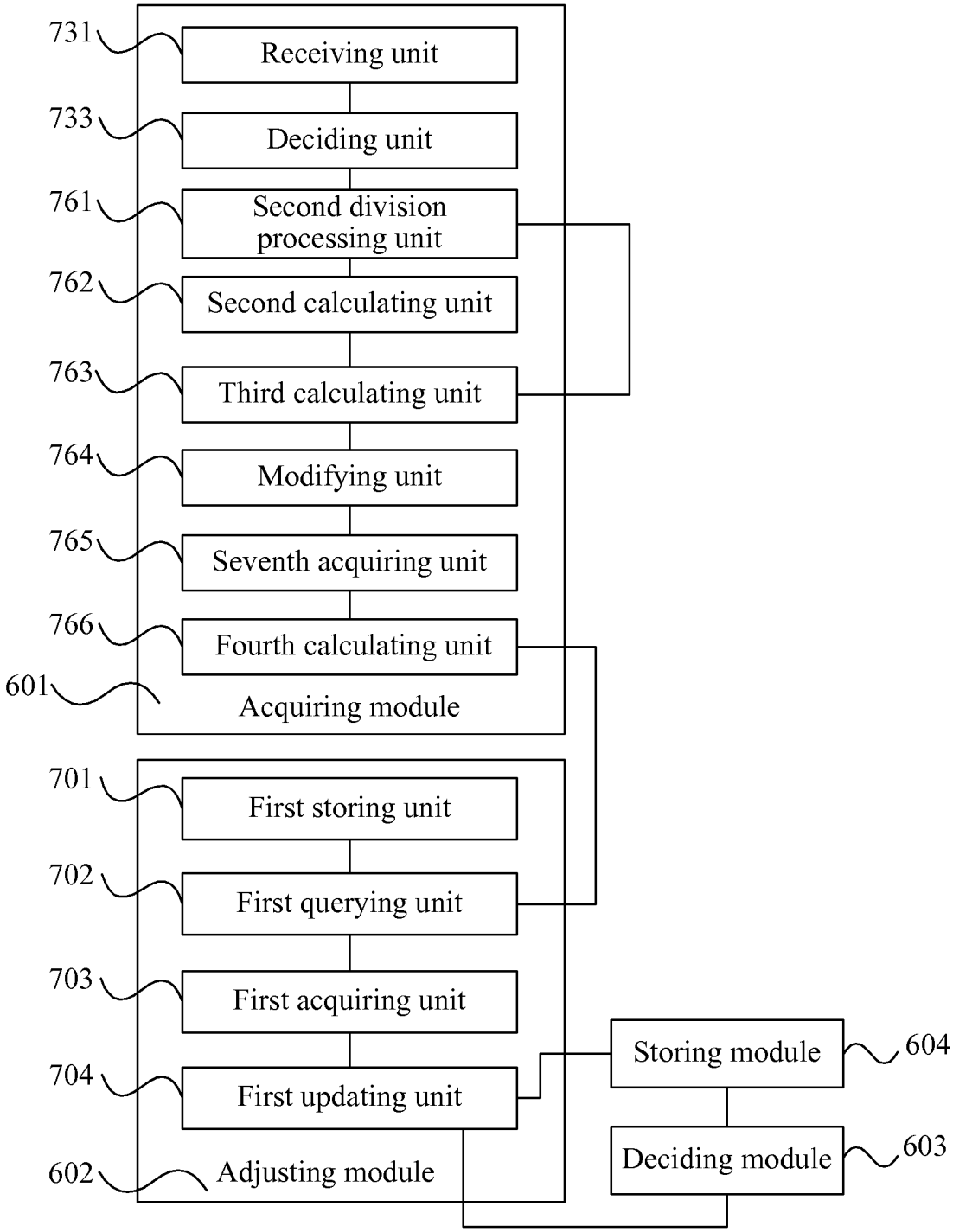
FIG. 15 is a schematic structural view of a tenth embodiment of the apparatus for VAD according to the present invention.

FIG. 15 is a schematic structural view of a tenth embodiment of the apparatus for VAD according to the present invention. Compared with the apparatus for VAD in the embodiment shown in FIG. 14, in the apparatus for VAD according to this embodiment, when the VAD decision criterion related parameter includes the primary decision threshold, the adjusting module 602 includes the first storing unit 701, the first querying unit 702, the first acquiring unit 703, and the first updating unit 704. The first storing unit 701 is configured to store a mapping between a fluctuant feature value and a decision threshold noise fluctuation bias thr_bias_noise. The first querying unit 702 is configured to query the mapping between the fluctuant feature value and the decision threshold noise fluctuation bias thr_bias_noise from the first storing unit 701, and acquire a decision threshold noise fluctuation bias thr_bias_noise corresponding to a fluctuant feature value of a background noise, in which the decision threshold noise fluctuation bias thr_bias_noise is used to represent a threshold bias value under a background noise with different fluctuation. The first acquiring unit 703 is configured to acquire a primary decision threshold vad_thr by using the formula $vad_thr=f_1(snr)+f_2(snr) \cdot thr_bias_noise$, in which $f_1(snr)$ is a reference threshold corresponding to an SNR snr of a current background noise frame, and $f_2(snr)$ is a weighting coefficient of a decision threshold noise fluctuation bias thr_bias_noise corresponding to the SNR snr of the current background noise frame. The first updating unit 704 is configured to update the primary decision threshold in the VAD decision criterion related parameter to the primary decision threshold vad_thr acquired by the first acquiring unit 703.

Figure 16:
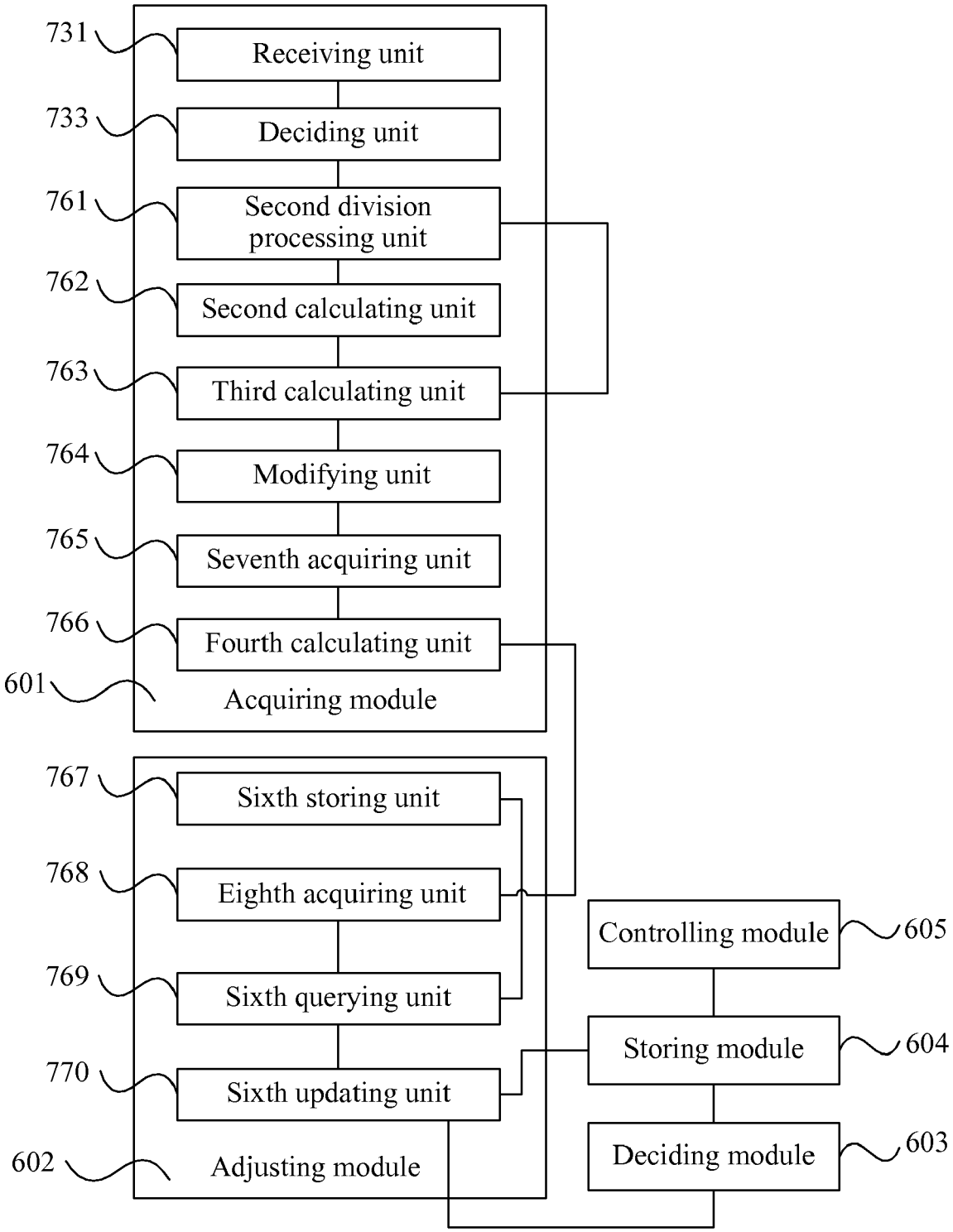
FIG. 16 is a schematic structural view of an eleventh embodiment of the apparatus for VAD according to the present invention.

FIG. 16 is a schematic structural view of an eleventh embodiment of the apparatus for VAD according to the present invention. Compared with the apparatus for VAD in the embodiment shown in FIG. 14, in the apparatus for VAD according to this embodiment, when the VAD decision criterion related parameter includes the primary decision threshold, the adjusting module 602 includes a sixth storing unit 767, an eighth acquiring unit 768, a sixth querying unit 769, and a sixth updating unit 770. The sixth storing unit 767 is configured to store a primary decision threshold table thr_tbl[ ], in which the primary decision threshold table thr_tbl[ ] includes a mapping between the fluctuation level, the SNR level, and the primary decision threshold vad_thr. The eighth acquiring unit 768 is configured to acquire the fluctuation level flux_idx corresponding to the current background noise frame MSSNR long term moving average $flux_{bgd}$ calculated by the fourth calculating unit 766, and acquire the SNR level snr_idx corresponding to the SNR snr of the current background noise frame. The sixth querying unit 769 is configured to query a primary decision threshold thr_tbl[snr_idx][flux_ idx] simultaneously corresponding to the fluctuation level flux_idx and the SNR level snr_idx from the primary decision threshold table thr_tbl[ ] stored by the sixth storing unit 767. The sixth updating unit 770 is configured to update the primary decision threshold in the decision criterion related parameter to the primary decision threshold thr_tbl[snr_idx][flux_idx] queried by the sixth querying unit.

Further, in the apparatus for VAD shown in FIG. 16, the primary decision threshold table thr_tbl[ ] may specifically include a mapping between the fluctuation level, the SNR level, the decision tendency, and the primary decision threshold vad_thr. Correspondingly, the eighth acquiring unit 768 is further configured to acquire a decision tendency op_idx corresponding to current working performance of the apparatus for VAD performing VAD decision, that is, it is prone to decide the current frame to be a voice frame or a background noise frame. Specifically, the current working performance of the apparatus for VAD may include saving bandwidth by the voice encoding quality after VAD startup and the VAD. The sixth querying unit 769 is specifically configured to query a primary decision threshold vad_thr=thr_tbl[snr_idx][flux_ idx][op_idx] corresponding to the fluctuation level flux_idx, the SNR level snr_idx, and the performance level op_idx simultaneously from the primary decision threshold table thr_tbl[ ] stored by the sixth storing unit 767. The sixth updating unit 770 is specifically configured to update the primary decision threshold in the decision criterion related parameter to the primary decision threshold vad_thr=thr_tbl [snr_idx][flux_idx][op_idx] queried by the sixth querying unit 769.

Further, in the apparatus for VAD according to the embodiments of the present invention, a controlling module 605 may be further included, configured to dynamically adjust any one or more VAD decision criterion related parameters: the primary decision threshold, the hangover length, and the hangover trigger condition according to the level of the background noise in the input signal. FIG. 16 shows one of the embodiments. Specifically, any one or more VAD decision criterion related parameters: the primary decision threshold, the hangover length, and the hangover trigger condition can be dynamically adjusted with the process in the embodiment shown in FIG. 5.

The embodiments of the present invention further provide an encoder, which may specifically include the apparatus for VAD according to any embodiment shown in FIGS. 6 to 16 of the present invention.

Persons of ordinary skill in the art should understand that all or a part of the steps of the method according to the embodiments of the present invention may be implemented by a program instructing relevant hardware. The program may be stored in a computer readable storage medium. When the program is run, the steps of the method according to the embodiments of the present invention are performed. The storage medium may be any medium that is capable of storing program codes, such as a ROM, a RAM, a magnetic disk, and an optical disk.

According to the embodiments of the present invention, when an input signal is a background noise, a fluctuant feature value used to represent fluctuation of the background noise can be acquired, adaptive adjustment is performed on a VAD decision criterion related parameter according to the fluctuant feature value, and VAD decision is performed on the input signal by using the decision criterion related parameter on which the adaptive adjustment is performed. Compared with the prior art, because the VAD decision criterion related parameter can be adaptive to the fluctuation of the background noise, higher VAD decision performance can be achieved in the case of different types of background noises, which improves the VAD decision efficiency and decision accuracy, thereby increasing utilization of limited channel bandwidth resources.

Finally, it should be noted that the above embodiments are merely provided for describing the technical solutions of the present invention, but not intended to limit the present invention. It should be understood by persons of ordinary skill in the art that although the present invention has been described in detail with reference to the exemplary embodiments, modifications or equivalent replacements can be made to the technical solutions described in the embodiments, as long as such modifications or replacements do not depart from the spirit and scope of the present invention.

What is claimed is:

1. A method for Voice Activity Detection (VAD), comprising:

Acquiring, via a programmed processor, a fluctuant feature value of a background noise when an input signal is the background noise, wherein the fluctuant feature value is used to represent fluctuation of the background noise;

performing an adaptive adjustment on a VAD decision criterion related parameter according to the fluctuant feature value, wherein the VAD decision criterion related parameter comprises any one or more of a primary decision threshold, a hangover trigger condition, a hangover length, and an update rate of a long term parameter related to background noise; and performing the VAD decision on the input signal by using the VAD decision criterion related parameter on which the adaptive adjustment is performed.

2. The method according to claim 1, wherein the VAD decision criterion related parameter comprises the primary decision threshold, and wherein performing the adaptive adjustment on the VAD decision criterion related parameter according to the fluctuant feature value comprises:

querying a mapping between the fluctuant feature value and a decision threshold noise fluctuation bias thr_bias_noise, acquiring the decision threshold noise fluctuation bias thr_bias_noise corresponding to the fluctuant feature value of the background noise, wherein the decision threshold noise fluctuation bias thr_bias_noise is used to represent a threshold bias value under the background noise with different fluctuation;

acquiring a primary decision threshold vad_thr by using the formula $vad_thr=f_1(snr)+f_2(snr)\cdot thr_bias_noise$, wherein $f_1(snr)$ is a reference threshold corresponding to a Signal to Noise Ratio (SNR) snr of a current background noise frame, and $f_2(snr)$ is a weighting coefficient of the decision threshold noise fluctuation bias thr_bias_noise corresponding to the SNR snr of the current background noise frame; and updating the primary decision threshold in the decision criterion related parameter to the primary decision threshold vad_thr.

3. The method according to claim 1, wherein the VAD decision criterion related parameter comprises the hangover trigger condition, and wherein performing the adaptive adjustment on the VAD decision criterion related parameter according to the fluctuant feature value comprises:

querying a successive-voice-frame length burst_cnt_noise_tbl[fluctuant feature value] corresponding to the fluctuant feature value of the background noise from a successive-voice-frame length noise fluctuation mapping table burst_cnt_noise_tbl[ ], querying a determined voice threshold burst_thr_noise_tbl [fluctuant feature value] corresponding to the fluctuant feature value of the background noise from a threshold bias table of determined voice according to noise fluctuation burst_thr_noise_tbl[ ];

acquiring a successive-voice-frame quantity threshold M by using the formula $M=f_3(snr)+f_4(snr)\cdot burst_cnt_noise_tbl[fluctuant\ feature\ value]$, wherein $f_3(snr)$ is a reference quantity threshold corresponding to an SNR snr of a current background noise frame and $f_4(snr)$ is a weighting coefficient of the successive-voice-frame length burst_cnt_noise_tbl[fluctuant feature value] corresponding to the SNR snr of the current background noise frame;

acquiring a determined voice frame threshold burst_thr by using the formula $burst_thr=f_5(snr)+f_6(snr)\cdot burst_thr_noise_tbl[fluctuant\ feature\ value]$, wherein $f_5(snr)$ is a reference voice frame threshold corresponding to the SNR snr of the current background noise frame and $f_6(snr)$ is a weighting coefficient of a determined voice threshold burst_thr_noise_tbl[fluctuant feature value] corresponding to the SNR snr of the current background noise frame; and updating the hangover trigger condition in the decision criterion related parameter according to the successive-voice-frame quantity threshold M and the determined voice frame threshold burst_thr.

4. The method according to claim 1, wherein the VAD decision criterion related parameter comprises the hangover length, the performing the adaptive adjustment on the VAD decision criterion related parameter according to the fluctuant feature value comprises:

querying a hangover length hangover_noise_tbl[fluctuant feature value] corresponding to the fluctuant feature value of the background noise from a hangover length noise fluctuation mapping table hangover_noise_tbl[ ];

acquiring a hangover counter reset maximum value hangover_max by using the formula $hangover_max=f_7(snr)+f_8(snr)\cdot hangover_noise_tbl[fluctuant\ feature\ value]$, wherein $f_7(snr)$ is a reference reset value corresponding to an SNR snr of a current background noise frame, and $f_8(snr)$ is a weighting coefficient of a hangover length hangover_noise_tbl[fluctuant feature value] corresponding to the SNR snr of the current background noise frame; and updating the hangover length in the VAD decision criterion related parameter to the hangover counter reset maximum value hangover_max.

5. The method according to claim 1, wherein the fluctuant feature value comprises a quantized value idx of a long term moving average hb_noise_mov of a whitened background noise spectral entropy; and wherein acquiring the fluctuant feature value of the background noise when the input signal is the background noise comprises:

receiving a current frame of the input signal;

dividing the current frame of the input signal into N sub-bands in a frequency domain, wherein N is an integer greater than 1;

calculating energies (enrg(i), i=0, 1, . . . , N−1) of the N sub-bands;

deciding whether the current frame is a background noise frame according to a VAD decision criterion;

calculating a long term moving average energy enrg_n(i) of the background noise frame on the N sub-bands by using the formula $enrg_n(i)=\alpha\cdot enrg_n+(1-\alpha)\cdot enrg(i)$ when the current frame is the background noise frame, wherein $\alpha$ is a forgetting coefficient for controlling an update rate of the long term moving average energy enrg_n(i) of the background noise frame respectively on the N sub-bands, and enrg_n is an energy of the background noise frame;

whitening a spectrum of a current background noise frame by using the formula enrg_w(i)=enrg/enrg_n(i), and acquiring an energy enrg_w(i) of the whitened background noise on an $i^{th}$ sub-band;

acquiring a whitened background noise spectral entropy hb by using the formula $$hb = -\sum_{i=0}^{N-1} p_i \cdot \log p_i,$$

wherein $$p_i = \text{enrg_w}(i) \Big/ \sum_{i=0}^{N-1} \text{enrg_w}(i);$$

acquiring a long term moving average hb_noise_mov of a whitened background noise spectral entropy by using the formula hb_noise_mov=β·hb_noise_mov+(1−β)·hb, wherein β is a forgetting factor for controlling an update rate of the long term moving average hb_noise_mov of the whitened background noise spectral entropy hb; and quantizing the long term moving average hb_noise_mov of the whitened background noise spectral entropy hb by using the formula idx=|(hb_noise_mov−A)/B|, so as to acquire a quantized value idx, wherein A and B are preset values.

6. The method according to claim 1, wherein the fluctuant feature value comprises a background noise frame SNR long term moving average $snr_n$_mov; and wherein acquiring the fluctuant feature value of the background noise when the input signal is the background noise comprises:

receiving a current frame of the input signal;

deciding whether the current frame is a background noise frame according to the VAD decision criterion; and acquiring the background noise frame SNR long term moving average $snr_n$_mov by using the formula $snr_n$_mov=k·$snr_n$_mov+(1−k)·snr when the current frame is the background noise frame, wherein snr is an SNR of the background noise frame, and k is a forgetting factor for controlling an update rate of the background noise frame SNR long term moving average $snr_n$_mov.

7. The method according to claim 6, wherein the update rate of a background noise related long term parameter is substantially the same as the update rate of the long term moving average $snr_n$_mov.

8. The method according to claim 7, wherein performing the adaptive adjustment on the VAD decision criterion related parameter according to the fluctuant feature value comprises: setting different values for the forgetting factor k for controlling the update rate of the background noise frame SNR long term moving average $snr_n$_mov, when the SNR snr of the current background noise frame is different than a mean $snr_n$ of SNRs of last n background noise frames.

9. The method according to claim 8, further comprising:

dynamically adjusting any one or more of the VAD decision criterion related parameters: the primary decision threshold, the hangover length, and the hangover trigger condition according to a level of the background noise in the input signal.

10. The method according to claim 1, wherein the fluctuant feature value comprises a background noise frame modified segmental SNR (MSSNR) long term moving average $flux_{bgd}$; and wherein acquiring the fluctuant feature value of the background noise when the input signal is the background noise comprises:

receiving a current frame of the input signal;

deciding whether the current frame is a background noise frame according to the VAD decision criterion;

dividing a Fast Fourier Transform (FFT) spectrum of the current background noise frame into H sub-bands when the current frame is the background noise frame, wherein H is an integer greater than 1, and calculating energies ($E_{band}$(i), i=0, 1, . . . , H−1) of i sub-bands respectively by using the formula $$E_{band}(i) = \frac{p}{h(i) - l(i) + 1} \sum_{j=l(i)}^{h(i)} S_j + (1-p)E_{band_old}(i),$$

wherein l(i) and h(i) represent an FFT frequency point with the lowest frequency and an FFT frequency point with the highest frequency in an $i^{th}$ sub-band respectively, $S_j$ represents an energy of a $j^{th}$ frequency point on the FFT spectrum, $E_{band_old}$(i) represents an energy of the $i^{th}$ sub-band in a previous background noise frame, and P is a preset constant;

calculating an SNR snr(i) of the $i^{th}$ sub-band in the current background noise frame according to a formula snr(i)=10 log($E_{band}$(i)/$\overline{E_{band_n}(i)}$), wherein $\overline{E_{band_n}(i)}$ is a background noise long term moving average acquired by updating the background noise long term moving average $\overline{E_{band_n}(i)}$ using the energy of the $i^{th}$ sub-band in the previous background noise frame by using the formula $\overline{E_{band_n}(i)}$=q·$\overline{E_{band_n}(i)}$+(1−q)·$E_{band}$ wherein q is a preset constant;

modifying the SNR snr(i) of the $i^{th}$ sub-band in the current background noise frame respectively by using the formula $$msnr(i) = \begin{cases} \text{MAX}\left[\text{MIN}\left[\frac{snr(i)^3}{C1}, 1\right], 0\right], & i \in \text{first set} \\ \text{MAX}\left[\text{MIN}\left[\frac{snr(i)^3}{C2}, 1\right], 0\right], & i \in \text{second set} \end{cases},$$

wherein msnr(i) is the SNR snr of the $i^{th}$ sub-band modified, C1 and C2 are preset real constants greater than 0, and values in the first set and the second set form a set [0, H−1];

acquiring a current background noise frame MSSNR by using the formula $$MSSNR = \sum_{i=0}^{H-1} msnr(i);$$

and calculating a current background noise frame MSSNR long term moving average $flux_{bgd}$ by using the formula $flux_{bgd}$=r·$flux_{bgd}$+(1−r)·MSSNR, wherein r is a forgetting coefficient for controlling an update rate of the current background noise frame MSSNR long term moving average $flux_{bgd}$.

11. The method according to claim 10, further comprising:

dynamically adjusting any one or more of the VAD decision criterion related parameters: the primary decision threshold, the hangover length, and the hangover trigger condition according to a level of the background noise in the input signal.

12. An apparatus for Voice Activity Detection (VAD) comprising:

an acquiring module, executed on a programmed processor, configured to acquire a fluctuant feature value of a background noise when an input signal comprises the background noise, wherein the fluctuant feature value is used to represent fluctuation of the background noise;

an adjusting module configured to perform adaptive adjustment on a VAD decision criterion related parameter according to the fluctuant feature value;

a deciding module configured to perform a VAD decision on the input signal by using the VAD decision criterion related parameter on which the adaptive adjustment is performed; and a storing module configured to store the VAD decision criterion related parameter, wherein the VAD decision criterion related parameter comprises any one or more of a primary decision threshold, a hangover trigger condition, a hangover length, and an update rate of an update rate of a long term parameter related to background noise.

13. The apparatus according to claim 12, wherein the VAD decision criterion related parameter comprises the primary decision threshold, and wherein the adjusting module comprises:

a first storing unit configured to store a mapping between the fluctuant feature value and a decision threshold noise fluctuation bias thr_bias_noise;

a first querying unit configured to query the mapping between the fluctuant feature value and the decision threshold noise fluctuation bias thr_bias_noise, and acquire the decision threshold noise fluctuation bias thr_bias_noise corresponding to the fluctuant feature value of the background noise, wherein the decision threshold noise fluctuation bias thr_bias_noise is used to represent a threshold bias value under a background noise with different fluctuation;

a first acquiring unit configured to acquire a primary decision threshold vad_thr by using the formula $vad_thr=f_1(snr)+f_2(snr)\cdot thr_bias_noise$, wherein $f_1(snr)$ is a reference threshold corresponding to a Signal to Noise Ratio (SNR) snr of a current background noise frame, and $f_2(snr)$ is a weighting coefficient of the decision threshold noise fluctuation bias thr_bias_noise corresponding to the SNR snr of the current background noise frame; and a first updating unit configured to update the primary decision threshold in the decision criterion related parameter to the primary decision threshold vad_thr acquired by the first acquiring unit.

14. The apparatus according to claim 12, wherein the VAD decision criterion related parameter comprises the hangover trigger condition, and wherein the adjusting module comprises:

a second storing module configured to store a successive-voice-frame length fluctuation mapping table burst_cnt_noise_tbl[ ] and a determined voice threshold fluctuation bias value table burst_thr_noise_tbl[ ], wherein the successive-voice-frame length fluctuation mapping table burst_cnt_noise_tbl[ ] comprises a mapping between the fluctuant feature value and a successive-voice-frame length, and wherein the determined voice threshold fluctuation bias value table burst_thr_noise_tbl[ ] comprises a mapping between the fluctuant feature value and a determined voice threshold;

a second querying unit configured to query a successive-voice-frame length burst_cnt_noise_tbl[fluctuant feature value] corresponding to the fluctuant feature value of the background noise from the successive-voice-frame length noise fluctuation mapping table burst_cnt_noise_tbl[ ], and query the determined voice threshold burst_thr_noise_tbl[fluctuant feature value] corresponding to the fluctuant feature value of the background noise from the threshold bias table of determined voice according to noise fluctuation burst_thr_noise_tbl[ ];

a second acquiring unit configured to:

acquire a successive-voice-frame quantity threshold M by using the formula $M=f_3(snr)+f_4(snr)\cdot burst_cnt_noise_tbl[fluctuant\ feature\ value]$, wherein $f_3(snr)$ is a reference quantity threshold corresponding to the SNR snr of the current background noise frame and $f_4(snr)$ is a weighting coefficient of the successive-voice-frame length burst_cnt_noise_tbl[fluctuant feature value] corresponding to the SNR snr of the current background noise frame; and acquire a determined voice frame threshold burst_thr by using the formula $burst_thr=f_5(snr)+f_6(snr)\cdot burst_thr_noise_tbl[fluctuant\ feature\ value]$ wherein $f_5(snr)$ is a reference voice frame threshold corresponding to the SNR snr of the current background noise frame and $f_6(snr)$ is a weighting coefficient of the determined voice threshold burst_thr_noise_tbl[fluctuant feature value] corresponding to the SNR snr of the current background noise frame; and a second updating unit configured to update the hangover trigger condition in the VAD decision criterion related parameter according to the successive-voice-frame quantity threshold M and the determined voice frame threshold burst_thr acquired by the second acquiring unit.

15. The apparatus according to claim 12, wherein the decision criterion related parameter comprises the hangover length, and wherein the adjusting module comprises:

a third storing unit configured to store a hangover length noise fluctuation mapping table hangover_noise_tbl[ ], wherein the hangover length noise fluctuation mapping table hangover_noise_tbl[ ] comprises a mapping between the fluctuant feature value and the hangover length;

a third querying unit configured to query a hangover length hangover_nosie_tbl[fluctuant feature value] corresponding to the fluctuant feature value of the background noise from the hangover length noise fluctuation mapping table hangover_noise_tbl[ ];

a third acquiring unit configured to acquire a hangover counter reset maximum value hangover_max by using the formula $hangover_max=f_7(snr)+f_8(snr)\cdot hangover_noise_tbl[fluctuant\ feature\ value]$, wherein $f_7(snr)$ is a reference reset value corresponding to the SNR snr of the current background noise frame, and $f_8(snr)$ is a weighting coefficient of the hangover length hangover_nosie_tbl[idx] corresponding to the SNR snr of the current background noise frame; and a third updating unit configured to update the hangover length in the VAD decision criterion related parameter to the calculated hangover counter reset maximum value hangover_max acquired by the third acquiring unit.

16. The apparatus according to claim 12, wherein the fluctuant feature value comprises a quantized value idx of a long term moving average hb_noise_mov of a whitened background noise spectral entropy; and wherein the acquiring module comprises:

a receiving unit configured to receive a current frame of the input signal;

a first division processing unit configured to:

divide the current frame of the input signal into N sub-bands in a frequency domain, wherein N is an integer greater than 1; and calculate energies (enrg(i), i=0, 1, . . . , N−1) of the N sub-bands respectively;

a deciding unit configured to decide whether the current frame of the input signal is a background noise frame according to a VAD decision criterion;

a first calculating unit configured to calculate a long term moving average energy enrg_n(i) of the background noise frame respectively on the N sub-bands by using the formula enrg_n(i)=α·enrg_n+(1−α)·enrg (i) according to a decision result of the deciding unit when the current frame is a background noise frame, wherein α is a forgetting coefficient for controlling an update rate of the long term moving average energy enrg_n(i) of the background noise frame respectively on the N sub-bands, and enrg_n is an energy of the background noise frame;

a whitening unit configured to whiten a spectrum of the current background noise frame by using the formula enrg_w(i)=enrg(i)/enrg_n(i), and acquire an energy enrg_w(i) of the whitened background noise on an $i^{th}$ sub-band;

a fourth acquiring unit configured to acquire a whitened background noise spectral entropy hb by using the formula $$hb = -\sum_{i=0}^{N-1} p_i \cdot \log p_i,$$

wherein $$p_i = \text{enrg_w}(i) \Big/ \sum_{i=0}^{N-1} \text{enrg_w}(i);$$

a fifth acquiring unit configured to acquire a long term moving average hb_noise_mov of a whitened background noise spectral entropy by using the formula hb_noise_mov=β·hb_noise_mov+(1-β)·hb, wherein β is a forgetting factor for controlling an update rate of the long term moving average hb_noise_mov of a whitened background noise spectral entropy; and a quantization processing unit configured to quantize the long term moving average hb_noise_mov of a whitened background noise spectral entropy by using the formula idx=|(hb_noise_mov−A)/B|, so as to acquire a quantized value idx, wherein A and B are preset values.

17. The apparatus according to claim 12, wherein the fluctuant feature value comprises a background noise frame SNR long term moving average $snr_n$_mov; and wherein the acquiring module comprises:

a receiving unit configured to receive a current frame of the input signal;

a deciding unit configured to decide whether the current frame of the input signal is a background noise frame according to the VAD decision criterion; and a sixth acquiring unit configured to acquire a background noise frame SNR long term moving average $snr_n$_mov by using the formula $snr_n$_mov=k·$snr_n$_mov+(1−k)·snr according to a decision result of the deciding unit when the current frame is a background noise frame, wherein snr is an SNR of the current background noise frame, and k is a forgetting factor for controlling an update rate of the background noise frame SNR long term moving average $snr_n$_mov.

18. The apparatus according to claim 17, wherein the update rate of the background noise related long term parameter comprises an update rate of the long term moving average $snr_n$_mov, and wherein the adjusting module comprises:

a control unit configured to set different values for the forgetting factor k for controlling the update rate of the background noise frame SNR long term moving average $snr_n$_mov when the SNR snr of the current background noise frame is different than a mean $snr_n$ of SNRs of last n background noise frames.

19. The apparatus according to claim 12, wherein the fluctuant feature value comprises a background noise frame long modified segmental SNR (MSSNR) long term moving average $flux_{bgd}$, and wherein the acquiring module comprises:

a receiving unit configured to receive a current frame of the input signal;

a deciding unit configured to decide whether the current frame of the input signal is a background noise frame according to a VAD decision criterion;

a second division processing unit configured to divide an Fast Fourier Transform (FFT) spectrum of the current background noise frame into H sub-bands according to the decision result of the deciding unit when the current frame is a background noise frame, wherein H is an integer greater than 1, and calculate energies ($E_{band}$(i), i=0, 1, . . . , H−1) of i sub-bands respectively by using the formula $$E_{band}(i) = \frac{p}{h(i) - l(i) + 1} \sum_{j=l(i)}^{h(i)} S_j + (1-p)E_{band_old}(i),$$

wherein l(i) and h(i) represent an FFT frequency point with the lowest frequency and an FFT frequency point with the highest frequency in an $i^{th}$ sub-band respectively, $S_j$ represents an energy of a $j^{th}$ frequency point on the FFT spectrum, $E_{band_old}$(i) represents an energy of the $i^{th}$ sub-band in a previous background noise frame, and P is a preset constant;

a second calculating unit configured to update a background noise long term moving average $\overline{E_{band_n}(i)}$ using the energy of the $i^{th}$ sub-band in a previous background noise frame by using the formula $\overline{E_{band_n}(i)}=q\cdot\overline{E_{band_n}(i)}+(1-q)\cdot E_{band}(i)$, wherein q is a preset constant;

a third calculating unit configured to calculate an SNR snr(i) of the $i^{th}$ sub-band in the current background noise frame respectively by using the formula snr(i)=10 log ($E_{band}$(i)/$\overline{E_{band_n}(i)}$);

a modifying unit configured to modify the snr(i) of the $i^{th}$ sub-band in the current background noise frame respectively by using the formula $$msnr(i) = \begin{cases} \mathrm{MAX}\left[\mathrm{MIN}\left[\frac{snr(i)^3}{C1}, 1\right], 0\right], & i \in \text{first set} \\ \mathrm{MAX}\left[\mathrm{MIN}\left[\frac{snr(i)^3}{C2}, 1\right], 0\right], & i \in \text{second set} \end{cases},$$

wherein msnr(i) is the SNR of the $i^{th}$ sub-band modified, C1 and C2 are preset real constants greater than 0, and values in the first set and the second set form a set [0, H−1];

a seventh acquiring unit configured to acquire a current background noise frame MSSNR by using the formula $$MSSNR = \sum_{i=0}^{H-1} msnr(i);$$

and a fourth calculating unit configured to calculate a current background noise frame MSSNR long term moving average $flux_{bgd}$ by using the formula $flux_{bgd}=r \cdot flux_{bgd}+(1-r) \cdot MSSNR$, wherein r is a forgetting coefficient for controlling an update rate of the current background noise frame MSSNR long term moving average $flux_{bgd}$.

20. The apparatus according to claim 12 further comprising:

a controlling module configured to dynamically adjust any one or more decision criterion related parameters: the primary decision threshold, the hangover length, and the hangover trigger condition according to a level of the background noise in the input signal.

* * * * *